US007520839B2

(12) United States Patent
Rodgers, Jr.

(10) Patent No.: US 7,520,839 B2
(45) Date of Patent: Apr. 21, 2009

(54) PENDULUM STRIDING EXERCISE APPARATUS

(76) Inventor: Robert E. Rodgers, Jr., 974 King Point Dr., Canyon Lake, TX (US) 78133

( * ) Notice: Subject to any disclaimer, the term of this patent is extended or adjusted under 35 U.S.C. 154(b) by 779 days.

(21) Appl. No.: 11/005,223

(22) Filed: Dec. 6, 2004

(65) Prior Publication Data

US 2005/0124466 A1 Jun. 9, 2005

Related U.S. Application Data

(60) Provisional application No. 60/619,824, filed on Oct. 18, 2004, provisional application No. 60/585,787, filed on Jul. 6, 2004, provisional application No. 60/526,802, filed on Dec. 4, 2003.

(51) Int. Cl.
*A63B 22/00* (2006.01)
*A63B 22/06* (2006.01)

(52) U.S. Cl. ..... 482/52; 482/51; 482/57

(58) Field of Classification Search ..... 482/51–53, 482/57, 70, 79–80
See application file for complete search history.

(56) References Cited

U.S. PATENT DOCUMENTS

| | | | | |
|---|---|---|---|---|
| 4,940,233 | A | 7/1990 | Bull et al. | |
| 5,290,211 | A | 3/1994 | Stearns | |
| 5,299,993 | A * | 4/1994 | Habing | 482/52 |
| 5,401,226 | A | 3/1995 | Stearns | |
| 5,419,747 | A | 5/1995 | Piaget et al. | |
| 5,496,235 | A | 3/1996 | Stevens et al. | |
| 5,499,956 | A * | 3/1996 | Habing et al. | 482/52 |
| 5,577,985 | A | 11/1996 | Miller | |
| 5,584,781 | A | 12/1996 | Chen et al. | |
| 5,605,521 | A | 2/1997 | Hsieh | |
| 5,611,756 | A | 3/1997 | Miller | |
| 5,707,321 | A | 1/1998 | Maresh | |
| 5,735,773 | A | 4/1998 | Vittone et al. | |
| 5,792,028 | A | 8/1998 | Jarvie | |
| 5,857,940 | A | 1/1999 | Husted | |
| 5,876,307 | A | 3/1999 | Stearns et al. | |
| 5,876,308 | A | 3/1999 | Jarvie | |
| 5,910,072 | A | 6/1999 | Rawls et al. | |
| 5,919,118 | A | 7/1999 | Stearns et al. | |
| 5,967,944 | A | 10/1999 | Vittone et al. | |
| 5,971,892 | A | 10/1999 | Lee et al. | |
| 6,004,244 | A | 12/1999 | Simonson | |
| 6,027,430 | A | 2/2000 | Stearns et al. | |
| 6,036,622 | A | 3/2000 | Gordon | |
| 6,045,487 | A | 4/2000 | Miller | |
| 6,152,859 | A | 11/2000 | Stearns | |
| 6,183,397 | B1 | 2/2001 | Stearns et al. | |

(Continued)

*Primary Examiner*—Steve R Crow
(74) *Attorney, Agent, or Firm*—Fulbright & Jaworski L.L.P.

(57) ABSTRACT

An exercise apparatus may include a frame. A crank system may be coupled to the frame. A brake/inertia device may be coupled to the crank system. A pivotal linkage pendulum system may be coupled to the crank system. The pivotal linkage pendulum system may include one or more link members. An upper pivot point of at least one of the link members may be coupled to the crank system. In some embodiments, the upper pivot point of the at least one of the link members may be coupled to the crank system through a movable member. The upper pivot point may move in a back and forth path of motion or in a closed path motion. A foot member may be coupled to one or more of the link members. The foot member may include a footpad.

26 Claims, 13 Drawing Sheets

U.S. PATENT DOCUMENTS 6,206,804 B1 3/2001 Maresh
6,217,485 B1 4/2001 Maresh
6,277,054 B1 8/2001 Kuo et al.
6,277,055 B1 8/2001 Birrell et al.
6,390,953 B1 5/2002 Maresh et al.
6,398,695 B2 6/2002 Miller
6,416,442 B1 7/2002 Stearns et al.
6,551,218 B2 4/2003 Goh
6,652,423 B1 11/2003 Chen et al.
6,672,992 B1 1/2004 Lo et al.
6,689,019 B2 2/2004 Ohrt et al.
6,761,665 B2 7/2004 Nguyen
6,830,538 B2 12/2004 Eschenbach
6,846,273 B1 1/2005 Stearns et al.
6,949,053 B1 9/2005 Stearns et al.
6,955,632 B2 10/2005 Wang et al.
6,966,869 B1 11/2005 Stearns et al.
6,991,587 B1 1/2006 Eschenbach
6,994,656 B2 2/2006 Liao et al.
6,994,657 B1 2/2006 Eschenbach
7,014,597 B2 3/2006 Tsai et al.
7,025,711 B2 4/2006 Eschenbach
7,041,035 B1 5/2006 Stearns et al.
7,052,438 B2 5/2006 Eschenbach
7,060,005 B2 6/2006 Carlsen et al.
7,137,927 B2 11/2006 Maresh et al.
7,182,714 B2 2/2007 Moon
2001/0004623 A1 6/2001 Miller
2002/0094914 A1 7/2002 Maresh et al.
2003/0092532 A1 5/2003 Giannelli et al.
2004/0224825 A1 11/2004 Giannelli et al.
2005/0043148 A1* 2/2005 Maresh ..... 482/70
2005/0085344 A1 4/2005 Eschenbach
2005/0107219 A1 5/2005 Miller
2005/0181912 A1 8/2005 Eschenbach
2005/0202939 A1 9/2005 Lull et al.
2005/0250621 A1 11/2005 Corbalis et al.
2005/0277516 A1 12/2005 Girard et al.
2006/0003873 A1 1/2006 Kobayashi
2006/0040794 A1 2/2006 Giannelli et al.
2006/0100065 A1 5/2006 Maresh et al.

* cited by examiner

PENDULUM STRIDING EXERCISE APPARATUS

PRIORITY CLAIM

This application claims the benefit of U.S. Provisional Patent Application No. 60/526,802 entitled "Pendulum Striding Exercise Device" to Robert E. Rodgers, Jr., filed on Dec. 4, 2003; U.S. Provisional Patent Application No. 60/585,787 entitled "Pendulum Striding Exercise Device" to Robert E. Rodgers, Jr., filed on Jul. 6, 2004; and U.S. Provisional Patent Application No. 60/619,824 entitled "Pendulum Striding Exercise Device" to Robert E. Rodgers, Jr., filed on Oct. 18, 2004.

BACKGROUND

1. Field of the Invention

The present invention relates generally to an exercise apparatus. Certain embodiments relate to exercise apparatus that may allow exercise such as simulated walking, striding, jogging, and/or climbing.

2. Description of Related Art

Exercise devices have been in use for years. Some typical exercise devices that simulate walking, jogging, or climbing include cross country ski machines, stair climbing machines, elliptical motion machines, and pendulum motion machines.

In many exercise apparatus, the user's foot is constrained during exercise to patterns that may not accurately represent the typical path and/or position of a foot during walking and/or jogging. For example, cross country ski machines may not allow a user to lift the front of his/her foot above a flat plane defined by the top of the pedal or footpad. Elliptical machines may provide inertia that assists in changing directions of the foot pedals, which may make the exercise smoother and more comfortable. Elliptical machines may, however, constrain a user's foot to the mechanically defined elliptical path of the footpads or foot pedals. The elliptical path may be too long for shorter users or too short for taller users. Thus, an elliptical apparatus may not accommodate a variety of users. In addition, a jogging stride is longer than a walking stride so a fixed stride length apparatus may not optimally simulate several different types of exercise activities.

Pendulum motion exercise apparatus may allow variable stride length. The user's feet, however, may be constrained to follow the same arcuate path in both forward and rearward motion. Such motion may not accurately simulate a walking, striding, jogging, or climbing motion.

Certain pendulum motion exercise apparatus may have a fixed pendulum length. A fixed pendulum length may not allow for foot lift or vertical amplitude in the motion of the foot, and thus, may not provide naturally accommodating foot motion. Other pendulum motion exercise apparatus may have relatively short pendulum lengths that may not properly accommodate the path of motion of the foot or legs of the human body.

SUMMARY

An exercise apparatus may include a frame. The frame may include at least a portion that remains substantially stationary during use. A crank system may be coupled to the frame. The crank system may include one or more crank members. A brake/inertia device may be coupled to the crank system. In certain embodiments, an exercise apparatus may include a pivotal linkage pendulum system. A pivotal linkage pendulum system may be coupled to the crank system. A pivotal linkage pendulum system may include one or more link members. In certain embodiments, an upper pivot point of a link member may be coupled to the crank system. In some embodiments, the upper pivot point of the link member is coupled to the crank system through a movable member. The upper pivot point of the link member may move in a path during use. A foot member may be coupled to at least one of the link members. In some embodiments, a foot member may be coupled to a lower pivot point of at least one of the link members. The foot member may include a footpad.

In some embodiments, a pivotal linkage pendulum system may include a movable member. The movable member may be coupled to one or more link members. An upper pivot point of at least one of the link members may be coupled to a portion of the movable member. In certain embodiments, the upper pivot point of the at least one of the link members is at an upper end of the link member. The portion of the movable member may move in a back and forth path of motion. In some embodiments, the portion of the movable member may move in a closed path of motion.

In an embodiment, a movable member is coupled to and at least partially supported by the frame at or near a first end of the movable member. The movable member may be coupled to and at least partially supported by the crank system at or near a second end of the movable member. The portion of the movable member coupled to the upper pivot point of the at least one of the link members may be between the first end and the second end of the movable member. In some embodiments, the portion of the movable member coupled to the upper pivot point of the at least one of the link members is near the second end of the movable member.

In certain embodiments, a pivotal linkage pendulum system may include one or more link members. An upper pivot point of at least one of the link members may be coupled to the crank system such that the upper pivot point of the link member moves in a closed path. A foot member may be coupled to one or more of the link members. The foot member may include a footpad. In certain embodiments, a majority of a path of motion of the footpad is below the closed path. In some embodiments, substantially all of a path of motion of the footpad is below the closed path.

In certain embodiments, a distance between a footpad and an upper pivot point of a link member that moves in a path (e.g., a closed path or a back and forth path) is at least about 3 times the length of at least one crank member. In some embodiments, a distance between a footpad and an upper pivot point of a link member that moves in a path (e.g., a closed path or a back and forth path) is at least about 3 times a vertical amplitude of a path of motion of the footpad. In certain embodiments, a hip of a majority of users of the apparatus is positioned near at least a portion of the path of motion of an upper pivot point of a link member.

In certain embodiments, a majority of the path of an upper pivot point of a link member is positioned in front of a footpad plane when the footpad is at a center of its path of motion. The footpad plane may be located at a center of a footpad. In certain embodiments, a majority of a crank system is positioned in front of a footpad plane when the footpad is at a center of its path of motion. In some embodiments, a majority of the crank system is positioned near a footpad plane when the footpad is at a center of its path of motion. In some embodiments, a majority of the crank system is positioned behind a footpad plane when the footpad is at a center of its path of motion.

BRIEF DESCRIPTION OF THE DRAWINGS

Advantages of the present invention may become apparent to those skilled in the art with the benefit of the following detailed description and upon reference to the accompanying drawings in which.

Figure 1:
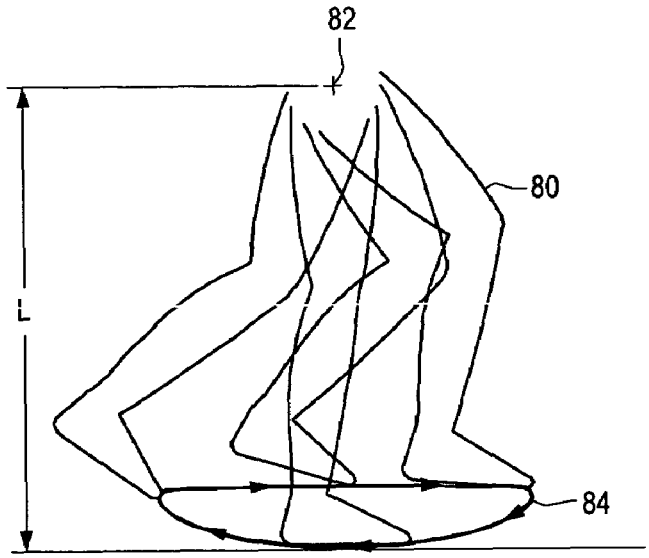
FIG. 1 depicts an embodiment of a human leg moving through a walking, striding, jogging, or climbing motion.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications, equivalents, and alternatives falling within the spirit and scope of the present invention as defined by the appended claims.

DETAILED DESCRIPTION

In the context of this patent, the term "coupled" means either a direct connection or an indirect connection (e.g., one or more intervening connections) between one or more objects or components. The phrase "directly attached" means a direct connection between objects or components. The term "support" means a first element, directly or indirectly, locates or positions a second element by pushing or pulling on the second element. The first element may be directly attached or coupled to the second element when providing support. The first element may be in compression while pushing or in tension while pulling on the second element.

The term "path" means any type of path that an object (e.g., a foot, a footpad, a link member, a movable member, or a coupling) or a point in space may undertake during motion. For example, a path may include a closed path or a back and forth path.

Figure 20:
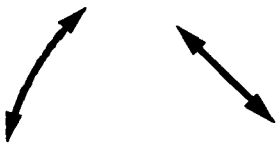
FIG. 20 depicts examples of embodiments of back and forth paths of motion.

A "back and forth path of motion" means motion along a curved or straight line with two end points. The back and forth motion moves along the same line but in opposite directions. Back and forth motion may be substantially horizontal motion, substantially vertical motion, or a combination of horizontal motion and vertical motion. Examples of back and forth paths of motion are depicted in FIG. 20.

Figure 21:
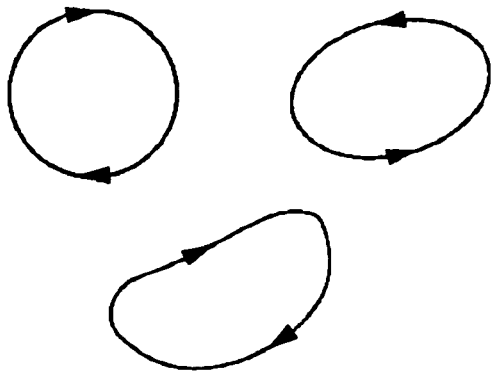
FIG. 21 depicts examples of embodiments of closed paths of motion.

A "closed path of motion" means motion along a continuous path that encloses an area. A closed path of motion has no end points. A closed path of motion may have many different shapes. The shape of a closed path may depend on the generating linkage mechanism. For example, a closed path may be an orbital path, an elliptical path, a saddle-shaped path, an asymmetrical path (e.g., a closed path with a smaller radius of curvature on one side of the path as compared to the other side), or an ovate or egg-shaped path. In some embodiments, a closed path may be elliptical, orbital, or oblong. Examples of closed paths of motion are depicted in FIG. 21.

The term "pendulum" means a body suspended from a pivoting point so that it swings back and forth. The term "amplitude" means the magnitude or extent of movement from a specified location (e.g., a starting position or an equilibrium position).

The phrase "average height user" means a user that has a height near an average human height. Mean height for males is about 5'9" and mean height for females is about 5'4.5" (data from U.S. Department of Health and Human Services). Thus, an average height user may be defined as a user with a height of about 5'6" or 5'7". An exemplary image of an average height user is used in one or more of the drawings described herein. A "majority of users" may have a height between about 5' and about 6'4". For the purposes of this patent, "a hip of an average height user" refers to a location of the hip of an average height user and "a hip of a majority of users" refers to a location of the hip of a majority of users. Users with similar heights may, however, have different torso and/or leg lengths that vary the position of each user's hip relative to other parts (e.g., the feet) of the user's body. Thus, there may be variations in the location of a user's hip between individuals.

Figure 1A:
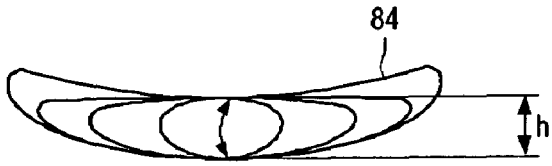
FIG. 1A depicts embodiments of paths of a user's foot moving through a walking, striding, jogging, or climbing motion.

FIG. 1 depicts an embodiment of a human leg moving through a walking, striding, jogging, or climbing motion. Leg 80, when fully extended, may act as a pendulum. Hip joint 82 may be a top of the pendulum about which leg 80 moves. Articulation of the ankle and knee joints may result in path 84 of the foot with a foot lift. FIG. 1A depicts several embodiments of path 84 that a user's foot may move through using an exercise apparatus as described herein. Path 84 may have a vertical amplitude "h" at a center of the path. Path 84 may have several different shapes due to variations in a horizontal amplitude of the path, as shown in FIG. 1A. The vertical amplitude "h", however, may remain substantially the same for the various embodiments of path 84 for an exercise apparatus with a fixed geometry. At or near walking or jogging speeds, "h" may be a relatively small percentage of extended leg length "L". Thus, a mechanical system that more accurately accommodates the natural path of motion of a user's leg and foot may include a pendulum system having a pendulum length that is relatively long compared to vertical amplitude "h".

Figure 2:
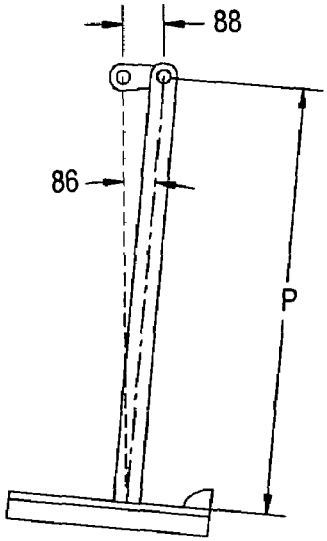
FIG. 2 depicts an embodiment of a linkage system with a relatively long pendulum length compared to a crank radius.
Figure 3:
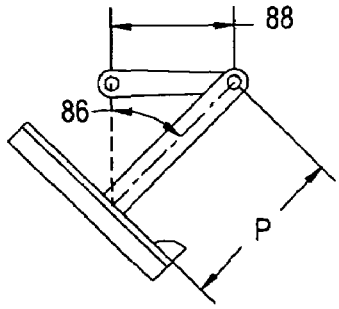
FIG. 3 depicts an embodiment of a linkage system with a relatively short pendulum length compared to a crank radius.

A vertical amplitude of a foot path of motion may be defined by a geometry of a crank system (e.g., a crank radius) and a linkage system (e.g., a pivotal linkage pendulum system). FIG. 2 depicts an embodiment of a linkage system with a relatively long pendulum length compared to a crank radius. FIG. 3 depicts an embodiment of a linkage system with a relatively short pendulum length compared to a crank radius. As shown in FIG. 2, pendulum angle 86 may be relatively small with pendulum length "P" relatively long compared to crank radius 88. A resultant horizontal force as a user steps on a foot member (e.g., a foot pedal) is equal to the stepping force multiplied by the tangent of pendulum angle 86. A resultant horizontal force in the embodiment depicted in FIG. 2 may be a relatively small portion (e.g., approximately 10%) of the stepping force. In FIG. 3, pendulum length "P" is relatively short compared to crank radius 88. A resultant horizontal force in the embodiment depicted in FIG. 3 may be a relatively large portion (e.g., approximately 100%) of the stepping force. Therefore, an exercise apparatus with a relatively long pendulum length "P" compared to crank radius 88 (e.g., a pendulum length at least about 3 times the crank radius) may provide a smaller resultant horizontal force. Thus, such an exercise apparatus may provide a smoother, a more comfortable, and a more accommodating motion for a user of the apparatus.

In certain embodiments, a pendulum motion exercise apparatus may include a brake/inertia system or device. Brake/inertia systems may receive energy, store energy, and deliver energy in an exercise apparatus. For example, a brake/inertia system may receive energy as a user steps downward at the beginning of a stride. The brake/inertia system may store the received energy. The stored energy may be delivered back to the exercise apparatus or the user to assist in lifting a linkage assembly or a portion of a linkage assembly (e.g., a foot member) over the top of a step or a stride. This energy transfer may assist in providing a more natural and a more comfortable walking, striding, jogging, and/or climbing motion for a user of an exercise apparatus.

In certain embodiments, an exercise apparatus may include a brake/inertia system and provide for a foot path of motion in which a vertical amplitude of the foot path of motion is relatively small compared to a pendulum length of the foot path of motion. Such an exercise apparatus may provide more natural, smoother, more comfortable, and more accommodating function and path of motion for a user of the exercise apparatus.

Figure 4:
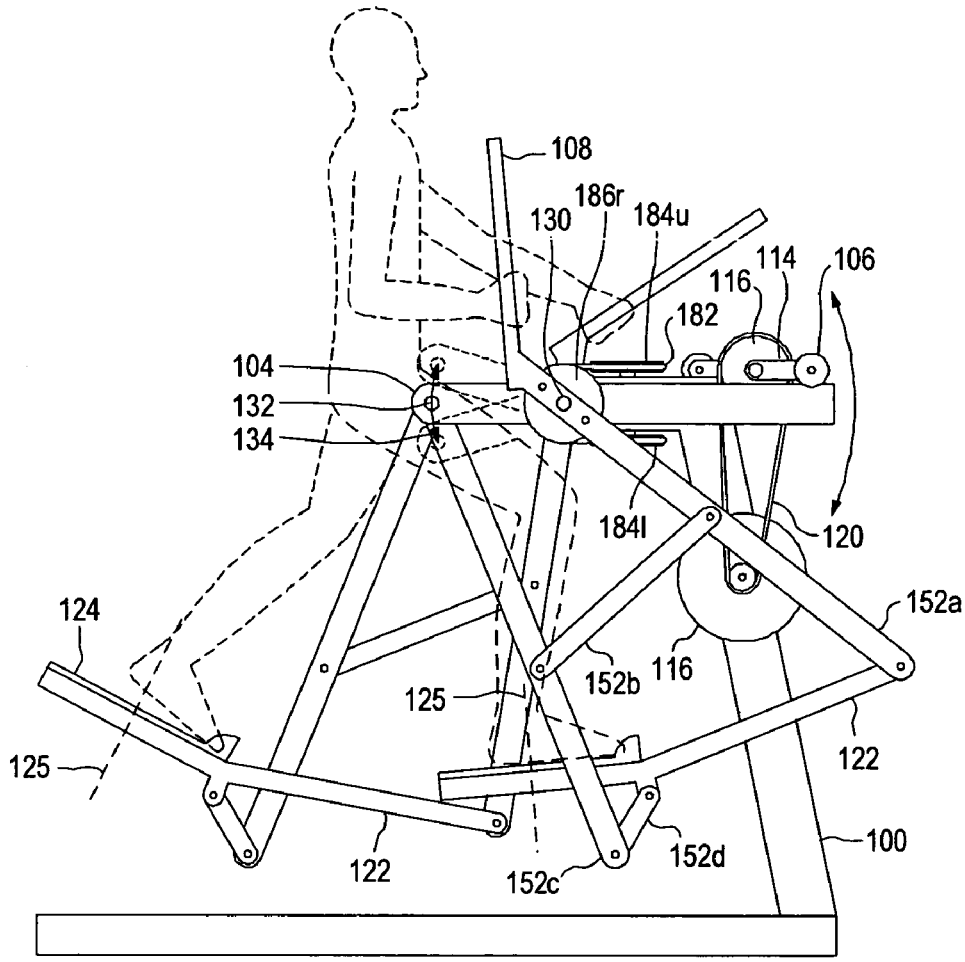
FIG. 4 depicts a side view of an embodiment of an exercise apparatus.

FIG. 4 depicts a side view of an embodiment of an exercise apparatus. Frame 100 may include a basic supporting framework and an upper stalk. Frame 100 may be any structure that provides support for one or more components of an exercise apparatus. In certain embodiments, all or a portion of frame 100 may remain substantially stationary during use. For example, all or a portion of frame 100 may remain substantially stationary relative to a floor on which the exercise apparatus is used. "Stationary" generally means that an object (or a portion of the object) has little or no movement during use. For example, an exercise apparatus would be "stationary" if the apparatus is operated in one location (in contrast to a movable exercise apparatus such as an ordinary bicycle), even if the apparatus wobbles or vibrates during use.

Foot members 122 may have footpads 124 or any other surface on which a user may stand. Footpad 124 is typically any surface or location on which a user's foot resides during use of an exercise apparatus (e.g., the footpad may be a pad or a pedal on which the user's foot resides during use). In some embodiments, footpad 124 may be a portion of foot member 122. Footpad plane 125 is a plane that intercepts footpad 124 at a right angle approximately near a center of the footpad, as shown in FIG. 4. Footpad plane 125, as depicted in FIG. 4, may be used in any of the embodiments and drawings described herein.

Link members 152*a*, 152*b*, 152*c*, 152*d* may be components of a multibar linkage system (e.g., a pivotal linkage pendulum system). In certain embodiments, a pivotal linkage pendulum system may include one or more pendulum members (e.g., link members 152*a*, 152*b*, 152*c*, 152*d*), foot members (e.g., foot members 122), and footpads (e.g., footpads 124). A pivotal linkage pendulum system may include left and right portions that are mirror images of each other. In certain embodiments, the left and right portions of a pivotal linkage pendulum system may move in opposition to each other. In an embodiment, link members 152*a*, 152*d* are coupled to (e.g., pivotally coupled to) foot members 122. Link members 152*a* may be coupled to (e.g., pivotally coupled to) frame 100 at point 130. Link members 152*a* may be supported by frame 100 at point 130. Point 130 is a location on frame 100 that may include an elongated axis perpendicular to the plane of FIG. 4 (i.e., the axis projects in or out of the two dimensional plane depicted in FIG. 4) for coupling members (e.g., link members 152*a*) to the frame. For example, point 130 may be a location with an axis or a shaft that couples the frame to both right and left side link members. In certain embodiments, link members 152*a* may support an end of foot members 122 coupled to the link members. Link members 152*d* may also support foot members 122. Foot members 122 may be coupled to a lower end of a pivotal linkage pendulum system. For example, foot members 122 may be coupled to link members 152*d*, which are in a lower end of the pivotal linkage pendulum system.

Link member 152*c* may be coupled to and supported by movable member 104 at point 132. An "upper pivot point" of link member 152*c* may be coupled to movable member 104 at point 132. In certain embodiments, the upper end of link member 152*c* may be the upper pivot point coupled to movable member 104 at point 132. In some embodiments, another portion of link member 152*c* may be coupled to movable member 104 at point 132 (e.g., the upper pivot point on the link member may be near the upper end of the link member). Point 132 is a location that may include an elongated axis perpendicular to the plane of FIG. 4 (i.e., the axis projects in or out of the two dimensional plane depicted in FIG. 4) for coupling two or more members together (e.g., link members 152*c* and movable members 104). For example, point 132 may be a location with an axis or a shaft that couples a right side movable member to a right side link member. A similar point or location may be on a left side of the exercise apparatus for coupling a left side movable member to a left side link member.

Link member 152*c* may act as a pendulum moving about an upper pivot point of the link member, which is coupled to movable member 104. The upper pivot point of link member 152*c* represents a top of the pendulum. Thus, link member 152*c* acts as a pendulum supported by movable member 104 at point 132, which is the point of coupling between the movable member and the upper pivot point of the link member.

In certain embodiments, movable member 104 may be a member of a pivotal linkage pendulum system. In some embodiments, movable members 104 may be motion generating members. Movable members 104 may be supported by frame 100 at point 130. Movable members 104 may rotate or pivot about point 130. Crank members 114 may engage movable members 104 with rollers 106. During use, as crank members 114 rotate, the crank members may displace movable members 104 and cause an end of the movable members to move in a back and forth path of motion at point 132 centered about point 130, which is approximately represented by arrow 134 in FIG. 4. The back and forth path of motion of movable member 104 may cause the upper pivot point of link member 152*c* coupled to the movable member at point 132 to move in a back and forth path of motion. The back and forth path of motion of the upper pivot point of link member 152*c* may include at least some vertical component. In certain embodiments, a hip of a majority of users may be positioned near at least a portion of the back and forth path of motion of the upper pivot points of link members 152*c*. In some embodiments, a hip of an average height user may be positioned near at least a portion of the back and forth path of motion of the upper pivot points of link members 152*c*. In certain embodiments, an exercise apparatus with movable members that move in a back and forth path of motion may be easier to use and learn than certain embodiments of other exercise apparatus because there is no preferred direction of movement for the movable members, as there may for an exercise apparatus with movable members that move in a closed path of motion.

Crank members 114 may cause right and left movable members 104 to move in opposition to each other (i.e., the right movable member moves downwards as the left movable member moves upwards, and vice versa). Crank members 114 may be coupled to pulley device 116. Pulley device 116 may be coupled to brake/inertia device 118 by belt 120. Thus, rotation of pulley device 116 may cause rotation of brake/inertia device 118.

Figure 7:
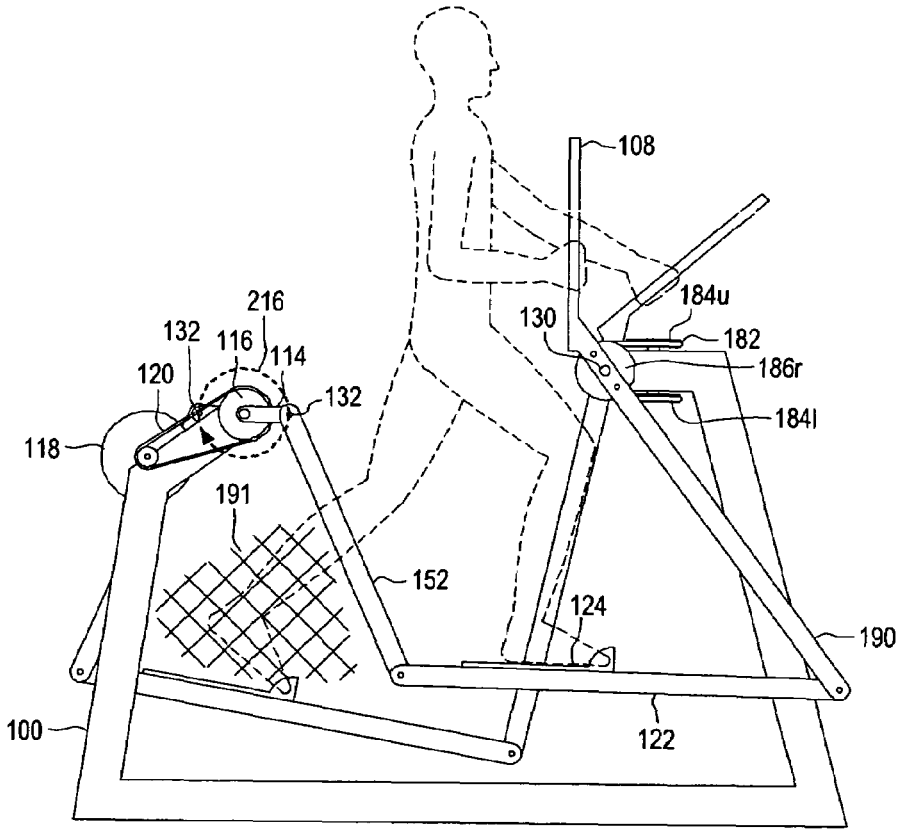
FIG. 7 depicts a side view of an embodiment of an exercise apparatus.
Figure 11:
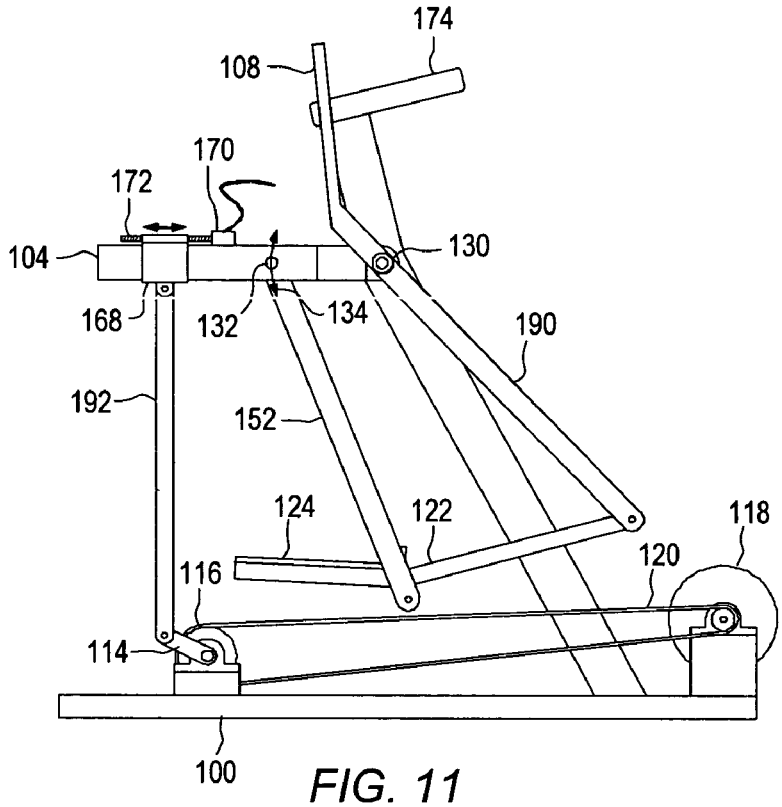
FIG. 11 depicts a side view of an embodiment of an exercise apparatus.

In certain embodiments, a "crank system" may include, in a generic case, crank member 114 coupled (either directly attached or indirectly attached) to pulley device 116. In some embodiments, a crank system may be formed from other types of devices that generally convert reciprocation or motion of a member to rotation. For example, a crank system may include a ring (e.g., a metal ring) supported by one or more rollers. Another example is a crank system with multiple crank members. In certain embodiments, a crank drive may include one or more intermediate components between the crank member and the pulley (e.g., an axle or connectors). In certain embodiments, a crank system may be directly attached to frame 100. In some embodiments, a crank system may be indirectly coupled to frame 100 with one or more components coupling the crank system to the frame. In certain embodiments, a majority of a crank system may be positioned in front of footpad plane 125 when footpad 124 is at a center of its path of motion, as depicted in the embodiment of FIG. 4. In some embodiments, a majority of a crank system may be positioned near footpad plane 125 when footpad 124 is at a center of its path of motion, as depicted in the embodiment of FIG. 11. In some embodiments, a majority of a crank system may be positioned behind footpad plane 125 when footpad 124 is at a center of its path of motion, as depicted in the embodiment of FIG. 7.

A brake/inertia device (e.g., brake/inertia device 118) may provide a load to affect the intensity of a cardiovascular workout. A brake/inertia device may include an energy-storing member (e.g., a flywheel) that is coupled to a linkage or crank system to increase inertia of the system. In some embodiments, a brake/inertia device may provide for a variable load. In some embodiments, a brake/inertia device may store energy provided by a user during a portion of an exercise motion and then may provide at least a portion of such stored energy back to the user during another portion of the exercise motion.

As shown in FIG. 4, movable member 104 may be straight and foot member 122 may be bent. In some embodiments, however, movable members 104 and/or foot members 122 may be straight, bent in one or more places, and/or curved. In certain embodiments, movable member 104 and/or foot members 122 are made of a solid or unitary construction. In some embodiments, movable member 104 and/or foot members 122 may include multiple components coupled or fastened to achieve a desired performance. Similarly, arm link members 108 and/or other link members may be straight, bent, or curved. Arm link members 108 and/or other link members may be unitary or may include multiple components.

In an embodiment, as a user ascends the exercise apparatus, the user stands on footpads 124 and initiates a walking, striding, jogging, or climbing motion. The weight of the user on footpads 124 combined with motion of the footpads and foot members 122 may cause a force to be transmitted to movable members 104. This transmitted force may cause rotation of crank members 114, pulley device 116, and brake/inertia device 118. As movable members 104 move, footpads 124 may alternately rise and fall. This rising and falling path of motion may simulate the rising and falling motion of a foot of a user during actual walking, striding, jogging, or climbing.

As a user steps downward at a front of a step or stride, a force may be transmitted through the pivotal linkage pendulum system to brake/inertia device 118. Brake/inertia device 118 may receive and store at least some of this transmitted energy. Brake/inertia device may deliver at least some of the stored energy back to the exercise apparatus to assist in lifting the pivotal linkage pendulum system over the top of a step or a stride.

Arm link members 108 may be coupled to link members 152*a*. In some embodiments, arm link members 108 may be included as a portion of link members 152*a* (i.e., arm link members 108 and link members 152*a* are made of a unitary construction). Arm link members 108 may include handles or other devices that may be grasped by a user of the exercise apparatus.

In certain embodiments, the right and left portions of a pivotal linkage pendulum system may be cross coupled. Cross coupling may cause the right and left portions to move in opposition. As shown in FIG. 4, a cross coupling system may include belt 182, pulley 186*r*, a mirror image pulley on a left side of the exercise apparatus, and idler pulleys 184*u* and 1841. Idler pulleys 184*u* and 1841 may be coupled to pulley 186*r* and its mirror image pulley by belt 182. Pulley 186*r* and its mirror image pulley may be directly attached (e.g., rigidly attached) to link members 152*a*. Belt 182 may be a continuous belt that causes pulley 186*r* and its mirror image pulley to rotate in direct opposition to one another so that the right and left side portions of the pivotal linkage pendulum system are cross coupled.

Figure 5:
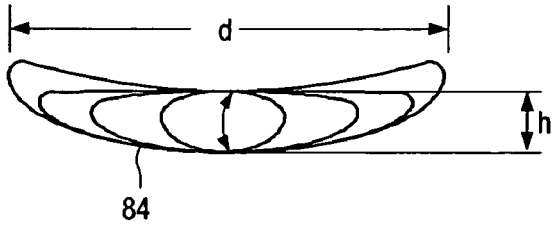
FIG. 5 depicts a path that a user's foot may follow during exercise using an embodiment of an exercise apparatus.

FIG. 5 depicts a path that a footpad (i.e., a user's foot) may follow during exercise using an embodiment of an exercise apparatus (e.g., the embodiment depicted in FIG. 4). A vertical amplitude "h" of the path may be determined by a geometry of the crank system (e.g., a length of a crank member) and/or a geometry of the pivotal linkage pendulum system. The geometry of the crank system and/or the geometry of the pivotal linkage pendulum system may determine a vertical amplitude of the back and forth path of motion of movable member 104, depicted in FIG. 4. The back and forth path of motion of movable member 104 causes the upper pivot point of link member 152*c* to move in a back and forth path of motion. This back and forth path of motion may include at least some vertical component. The vertical amplitude of the back and forth path of motion of the upper pivot point of link member 152*c* may determine the vertical amplitude "h" of the path of footpad 124. In certain embodiments, a vertical amplitude "h" of the path of a footpad (e.g., footpad 124) may be similar in magnitude to a vertical amplitude of a back and forth path of motion of an upper pivot point of a link member (e.g., link member 152*c*). In certain embodiments, a vertical amplitude of the back and forth path of motion of an upper pivot point of a link member (e.g., link member 152*c*) may be similar in magnitude to a length of a crank member (e.g., crank member 114). Thus, a vertical amplitude "h" of the path of a footpad (e.g., footpad 124) may be similar in magnitude to a length of a crank member (e.g., crank member 114).

In FIG. 5, a horizontal amplitude "d" of the path may be determined by an amount of force applied by a user to a footpad. A user may undertake an arcuate, substantially vertical climbing motion by limiting the horizontal amplitude of the path. A vertical climbing motion may be approximated when a vertical amplitude of a path of motion of a footpad is greater than a horizontal amplitude of the path of motion of the footpad. In certain embodiments, a user may be allowed to "instantaneously" or "dynamically" adjust his/her stride length (e.g., a horizontal amplitude of a path). The user may essentially be allowed to instantaneously or dynamically change his/her stride length by imparting variable forces to foot members 122 or footpads 124, depicted in FIG. 4. The user may selectively impart forces that vary the stride length and allow more accurate simulation of a walking, striding, jogging, and/or climbing motion.

An exercise apparatus may have a pendulum length that is relatively long compared to a vertical amplitude of a path of motion of a footpad (e.g., footpad 124 depicted in FIG. 4) or to a length of a crank member (e.g., crank member 114 depicted in FIG. 4). In certain embodiments, a pendulum length may approximate the length of a majority of users' legs. For example, a pendulum length may be within about 10% of the length of a majority of users legs. In some embodiments, a pendulum length may approximate the length of an average height user's legs. A footpad may be located at or near an end of a pendulum member (e.g., at or near an end of a link member such as link member 152*c*). Thus, a distance between a footpad (e.g., footpad 124) and a top of a pendulum (e.g., the upper pivot point of link member 152*c* (i.e., point 132) depicted in FIG. 4) may be representative of a pendulum length of an apparatus.

In certain embodiments, the distance between a footpad (e.g., footpad 124) and a top of a pendulum (e.g., the upper pivot point of link member 152*c*) may be at least 3 times a vertical amplitude of a path of motion of the footpad. In some embodiments, the distance between a footpad (e.g., footpad 124) and a top of a pendulum (e.g., the upper pivot point of link member 152*c*) may be at least 4 times, or at least 5 times, a vertical amplitude of a path of motion of the footpad. In certain embodiments, the distance between a footpad (e.g., footpad 124) and a top of a pendulum (e.g., the upper pivot point of link member 152*c*) may be at least 3 times a length of a crank member (e.g., crank member 114). In some embodiments, the distance between a footpad (e.g., footpad 124) and a top of a pendulum (e.g., the upper pivot point of link member 152*c*) may be at least 4 times, or at least 5 times, a length of a crank member (e.g., crank member 114).

In an embodiment, the distance between a footpad (e.g., footpad 124) and a top of a pendulum (e.g., the upper pivot point of link member 152*c*) is greater than about 2 feet. In some embodiments, the distance between a footpad (e.g., footpad 124) and a top of a pendulum (e.g., the upper pivot point of link member 152*c*) is greater than about 1 foot, or greater than about 1½ feet. In certain embodiments, the distance between a footpad (e.g., footpad 124) and a top of a pendulum (e.g., the upper pivot point of link member 152*c*) is between about 1 foot and about 5 feet, or between about 2 feet and about 4 feet.

Figure 6:
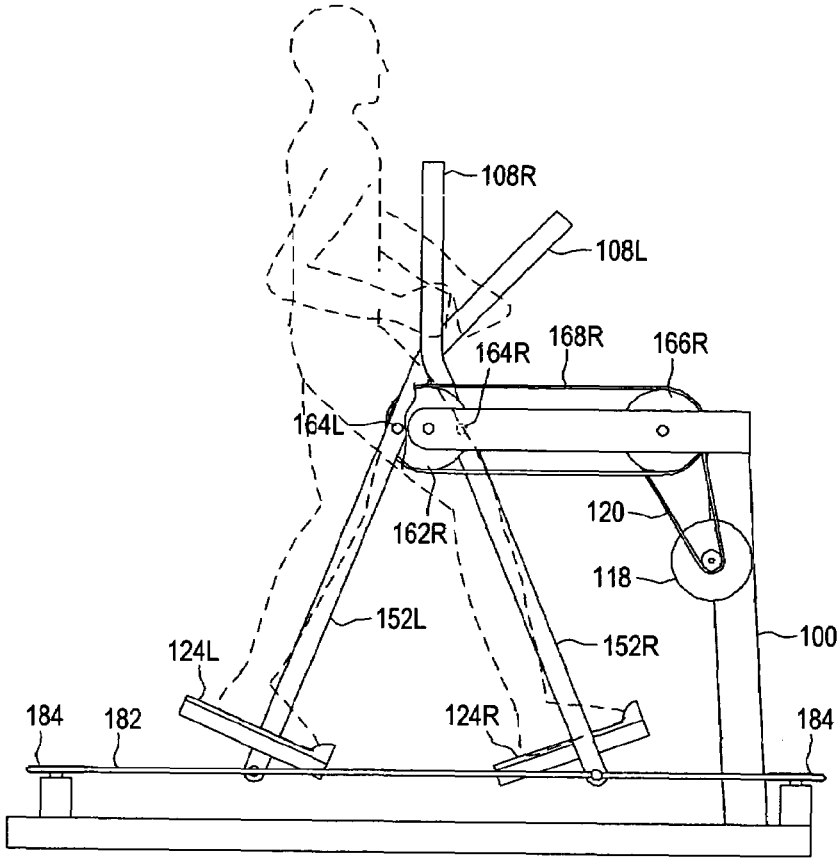
FIG. 6 depicts a side view of an embodiment of an exercise apparatus.

FIG. 6 depicts a side view of an embodiment of an exercise apparatus. Right side link member 152R and left side link member 152L may be coupled to (e.g., pivotally coupled to) right side sprocket 162R and a corresponding left side sprocket, respectively. In certain embodiments, link member 152R and left side link member 152L may be coupled to right side sprocket 162R and a corresponding left side sprocket at right side offset point 164R and left side offset point 164L, respectively. Right side offset point 164R and left side offset point 164L may be 180° out of phase so that as right link member 152R rises, left link member 152L falls, and vice versa. Link members 152R, 152L may act as pendulums with a top of the pendulums being located at right side offset point 164R and left side offset point 164L, respectively.

Sprocket 162R may be coupled to sprocket 166R by chain 168R. Left side sprockets may be coupled accordingly. Sprocket 166R and a corresponding left side sprocket may be coupled to brake/inertia device 118 using belt 120. Belt 120 may be coupled to an axle or shaft of sprocket 166R and its corresponding left side sprocket. In some embodiments, devices may be used to operate similarly to sprocket 162, sprocket 166, and chain 168. For example, a pulley and belt system may operate similarly to sprocket 162, sprocket 166, and chain 168.

In an embodiment, as a user ascends the exercise apparatus, the user stands on footpads 124R, 124L and initiates a walking, striding, or jogging motion. The weight of the user on footpads 124R, 124L combined with motion of the footpads and link members 152R, 152L may cause a force to be transmitted to sprocket 162R and its corresponding left side sprocket. This transmitted force may cause rotation of sprocket 162R and its corresponding left side sprocket. The rotation of sprocket 162R and its corresponding left side sprocket may cause a rising and falling path of motion of footpads 124R, 124L. This rising and falling path of motion may simulate the rising and falling motion of a foot of a user during actual walking, striding, or jogging. The rotation of sprocket 162R and its corresponding left side sprocket may cause rotation of sprocket 166R, its corresponding left side sprocket, and brake/inertia device 118. In certain embodiments, a hip of a majority of users may be positioned near at least a portion of the path of motion of the sprocket 162R and its corresponding left side sprocket.

Right and left link members 152R, 152L may be cross coupled using belt 182 and idler pulleys 184. Right and left link members 152R, 152L may be coupled to belt 182 so that the right and left link members move in opposition to each other. Belt 182 may be supported and guided by idler pulleys 184.

FIG. 7 depicts a side view of an embodiment of an exercise apparatus. Link members 190 may be coupled to (e.g., pivotally coupled to) foot members 122. Link members 190 may be coupled to (e.g., pivotally coupled to) frame 100 at point 130. Link members 190 may be supported by frame 100 at point 130 and may support an end of foot members 122 coupled to the link members. Foot members 122 may be coupled to link members 152 at a lower pivot point (e.g., a lower end) of the link members. In some embodiments, a lower pivot point of link members 152 may be at another portion of the link members (e.g., a portion near a lower end of the link members). Link members 152 may support an end of foot members 122 opposite from link members 190. In certain embodiments, link members 152 are members of a pivotal linkage pendulum system (e.g., pendulum members). In certain embodiments, a pivotal linkage pendulum system may include one or more pendulum members (e.g., link members 152), foot members (e.g., foot members 122), and footpads (e.g., footpads 124). A pivotal linkage pendulum system may include left and right portions that are mirror images of each other. In certain embodiments, the left and right portions of a pivotal linkage pendulum system may move in opposition to each other.

Link members 152 may be coupled to (e.g., pivotally coupled to) crank members 114 at upper pivot points of the link members (e.g., points 132). Link members 152 may act as pendulums with a top of the pendulums being located at points 132. During use, as crank members 114 rotate, the crank members may displace link members 152. Crank members 114 may cause right and left link members 152 to move in opposition to each other. Crank members 114 may be coupled to pulley device 116. Pulley device 116 may be coupled to brake/inertia device 118 by belt 120. Thus, rotation of pulley device 116 may cause rotation of brake/inertia device 118.

In an embodiment, as a user ascends the exercise apparatus, the user stands on footpads 124 and initiates a walking, striding, or jogging motion. The weight of the user on footpads 124 combined with motion of the footpads and foot members 122 may cause a force to be transmitted to crank members 114 through link members 152. This transmitted force may cause rotation of crank members 114, pulley device 116, and brake/inertia device 118. As crank members 114, pulley device 116, and brake/inertia device 118 rotate, the upper pivot points of link members 152 coupled to the crank members may move in a closed path (e.g., an orbital path approximately represented by arrow 216 in FIG. 7). This closed path motion causes footpads 124 to rise and fall as foot members 122 move forwards and backwards during exercise. The rising and falling path of motion of footpads 124 may simulate the rising and falling motion of a foot of a user during actual walking, striding, or jogging.

In certain embodiments, a majority of a path of motion of footpad 124 may be below the closed path of motion of the ends of link members 152 coupled to crank members 114. In some embodiments, substantially all of a path of motion of footpad 124 may be below the closed path of motion of the ends of link members 152 coupled to crank members 114. In certain embodiments, a hip of a majority of users may be positioned near at least a portion of the closed path of motion of the upper pivot points of link members 152 coupled to crank members 114. A user's foot may follow a path similar to the path shown in FIG. 5 during exercise.

As a user steps downward at a front of a step or stride, a force may be transmitted through the pivotal linkage pendulum system to brake/inertia device 118. Brake/inertia device 118 may receive and store at least some of this transmitted energy. Brake/inertia device may deliver at least some of the stored energy back to the exercise apparatus to assist in lifting the pivotal linkage pendulum system over the top of a step or a stride.

As shown in FIG. 7, arm link members 108 may be coupled to link members 190. In some embodiments, arm link members 108 may be included as a portion of link members 190 (e.g., arm link members 108 and link members 190 are made of a unitary construction). Arm link members 108 may include handles or other devices that may be grasped by a user of the exercise apparatus.

In certain embodiments, the right and left portions of a pivotal linkage pendulum system may be cross coupled. Cross coupling may cause the right and left portions to move in opposition. As shown in FIG. 7, a cross coupling system may include belt 182, pulley **186*r*, a mirror image pulley on a left side of the exercise apparatus, and idler pulleys 184*u* and 1841. Idler pulleys 184*u* and 1841 may be coupled to pulley 186*r* and its mirror image pulley by belt 182. Pulley 186*r* and its mirror image pulley may be directly attached (e.g., rigidly attached) to link members 190. Belt 182 may be a continuous belt that causes pulley 186*r*** and its mirror image pulley to rotate in direct opposition to one another so that the right and left side portions of the pivotal linkage pendulum system are cross coupled.

In certain embodiments, an exercise apparatus (e.g., the exercise apparatus shown in FIG. 7) may be constructed in a compact and economical manner. An exercise apparatus with a pendulum arm (e.g., link member 152) that is relatively long compared to a crank member (e.g., crank member 114) may allow the placement of a crank system in an elevated position. As shown in FIG. 7, crank member 114, pulley device 116, belt 120, and brake/inertia device 118 may be placed in an elevated position. Elevating the crank system may allow for a relatively long user stride compared to a length of the exercise apparatus because the user's feet may move back and forth into an area below the crank system, as represented by hatched area 191. A user's stride length would be shortened if a crank system were placed in a lowered position (e.g., by shortening a length of a pendulum arm (e.g., link member 152)) so that the crank system inhibits or restricts the user's stride. A longer stride length may be obtained with a crank system placed in a lowered position, but only by substantially increasing an overall length of the exercise apparatus. Thus, an exercise apparatus with a relatively long pendulum arm compared to a relatively short crank member may allow longer stride lengths to be obtained in a more compact and economical exercise apparatus.

Figure 8:
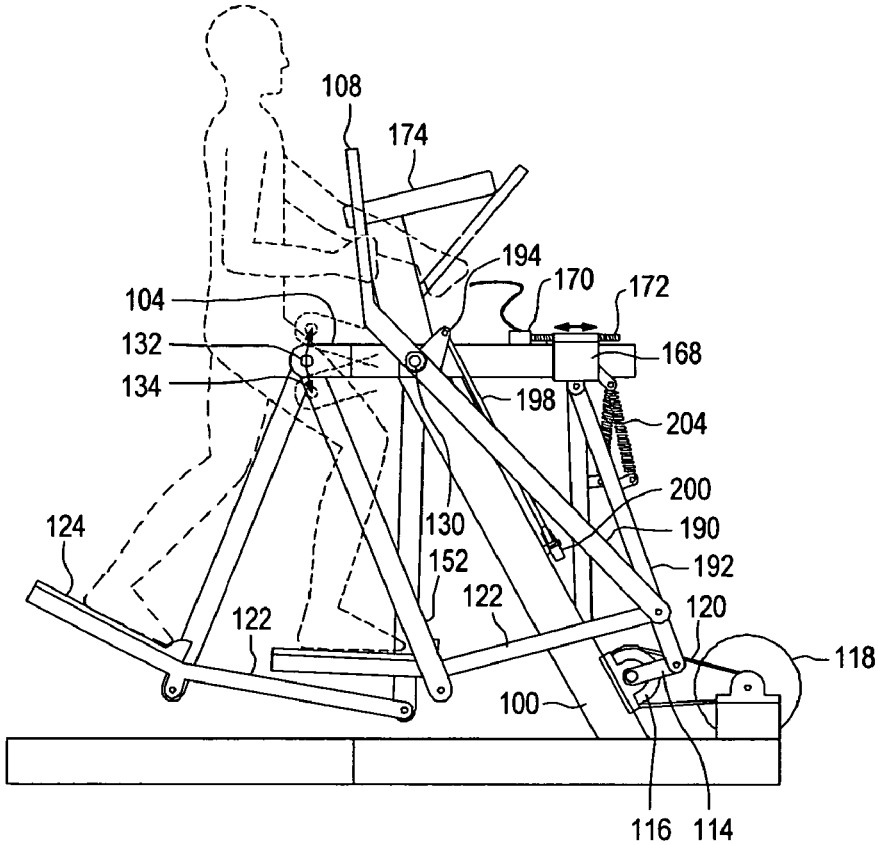
FIG. 8 depicts a side view of an embodiment of an exercise apparatus.
Figure 9:
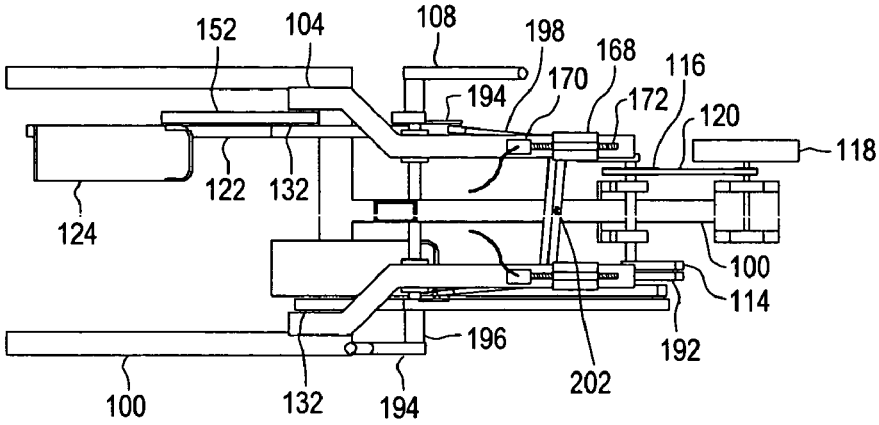
FIG. 9 depicts a top view of an embodiment of an exercise apparatus.

FIG. 8 depicts a side view of an embodiment of an exercise apparatus. FIG. 9 depicts a top view of the embodiment depicted in FIG. 8. Foot members 122 may be coupled to link members 152, link members 190, link members 192, and movable members 104. Foot members 122, link members 152, link members 190, link members 192, and movable members 104 may be members of a pivotal linkage pendulum system.

Link members 152 may be coupled to and supported by movable members 104. An upper pivot point of link member 152 may be coupled to movable member 104 at point 132. Link member 152 may act as a pendulum with a top of the pendulum being located at point 132. In certain embodiments, movable members 104 may be motion generating members. Movable members 104 may be supported by frame 100 at point 130. Movable members 104 may rotate or pivot about point 130.

Crank members 114 may engage movable members 104 through link members 192 and slider assembly 168. The crank system (e.g., crank members 114 and pulley device 116) may provide at least some support to movable members 104 and the pivotal linkage pendulum system (e.g., link members 152) through link members 192. During use, as crank members 114 rotate, the crank members may displace movable members 104 and cause an end of the movable members to move in a back and forth path of motion centered about point 130, as approximately represented by arrow 134 in FIG. 8. The back and forth path of motion of movable members 104 may cause the upper pivot points of link members 152 to move in a back and forth path of motion. This back and forth path of motion may have at least some vertical component. In certain embodiments, a hip of a majority of users may be positioned near at least a portion of the back and forth path of motion of the upper pivot points of link members 152.

Crank members 114 may cause right and left movable members 104 to move in opposition to each other (i.e., the right movable member moves downwards as the left movable member moves upwards, and vice versa). Crank members 114 may be coupled to pulley device 116. Pulley device 116 may be coupled to brake/inertia device 118 by belt 120. Thus, rotation of pulley device 116 may cause rotation of brake/inertia device 118.

In an embodiment, as a user ascends the exercise apparatus, the user stands on footpads 124 and initiates a walking, striding, jogging, or climbing motion. The weight of the user on footpads 124 combined with motion of the footpads and foot members 122 may cause a force to be transmitted to movable members 104. This transmitted force may cause rotation of crank members 114, pulley device 116, and brake/inertia device 118. As movable members 104 move, footpads 124 may alternately rise and fall. This rising and falling path of motion may simulate the rising and falling motion of a foot of a user during actual walking, striding, jogging, or climbing. A user's foot may follow a path similar to the path shown in FIG. 5 during exercise.

As a user steps downward at a front of a step or stride, a force may be transmitted through the pivotal linkage pendulum system to brake/inertia device 118. Brake/inertia device 118 may receive and store at least some of this transmitted energy. Brake/inertia device 118 may deliver at least some of the stored energy back to the exercise apparatus to assist in lifting the pivotal linkage pendulum system over the top of a step or a stride.

Arm link members 108 may be coupled to link members 190. In some embodiments, arm link members 108 may be included as a portion of link members 190 (i.e., arm link members 108 and link members 190 are made of a unitary construction). Arm link members 108 may include handles or other devices that may be grasped by a user of the exercise apparatus. In certain embodiments, arm link members 108 may move in an arcuate pattern during use.

In certain embodiments, left and right arm link members 108 may be cross coupled. Cross coupling may cause the right and left portions of the exercise apparatus to move in opposition to each other. Elements 194 may be coupled (e.g., rigidly attached) to arm link members 108 through tubes 196. Thus, each element 194 may move in unison with each respective arm link member 108 (e.g., the right element 194 may move in unison with the right arm link member 108). Connectors 198 may couple each of elements 194 (e.g., the right and left elements) to rocker arm 200. Connectors 198 may be connector rods. Rocker arm 200 may be pivotally coupled to an upper portion of frame 100 at point 202. In an embodiment, as arm link members 108 move, connectors 198 may cause rocking motion of rocker arm 200. This rocking motion may cause the right and left arm link members to move in opposition to each other (i.e., the rocking motion may cross couple the left and right arm link members).

During use of the apparatus depicted in FIGS. 8 and 9, slider assembly 168 may be located at a fixed position along movable member 104 so that the slider assembly moves along with the movable member at the fixed position. In certain embodiments, slider assembly 168 is movable back and forth (i.e., adjustable) along a length of movable member 104. The moving of the location of slider assembly 168 along a length of movable member 104 allows the slider assembly to be selectively positioned along the length of the movable member to determine a vertical amplitude of the path of motion of foot members 122 and/or footpads 124. Thus, adjusting the position of slider assembly 168 allows for varying the vertical amplitude of the path of motion of foot members 122 and/or footpads 124. Adjusting the position of slider assembly 168 varies the vertical amplitude of the path of motion of foot members 122 and/or footpads 124 by adjusting the geometry of the pivotal linkage pendulum system. For example, a vertical amplitude of a path, such as the path shown in FIG. 5, may be adjusted by adjusting a position of slider assembly 168, thus adjusting the vertical amplitude of the path of motion of foot members 122 and/or footpads 124.

In certain embodiments, movement (e.g., sliding movement) of slider assembly 168 may be controllable. For example, servomotor 170 and lead screw 172 may be used to control the movement of slider assembly 168. In some embodiments, servomotor 170 and lead screw 172 may be electrically coupled to controller 174. Controller 174 may be used to control servomotor 170 and to control a position of slider assembly 168. Controller 174 may include user-operated controls and/or a display for the user of the apparatus. In certain embodiments, a user may adjust a vertical amplitude of the user's stride by using controller 174 to activate servomotor 170. Activation of servomotor 170 rotates lead screw 172, which repositions slider assembly 168 along a length of movable member 104 and adjusts a vertical amplitude of the user's stride.

In certain embodiments, spring 204 may be coupled to slider assembly 168 and link member 192. Spring 204 may be used to assist in startup of an exercise if crank member 114 is in either a top dead center position or a bottom dead center position. Spring 204 may exert a greater force on one side (e.g., the left side or the right side) of the apparatus to displace crank member 114 slightly off either a top dead center position or a bottom dead center position.

Figure 10:
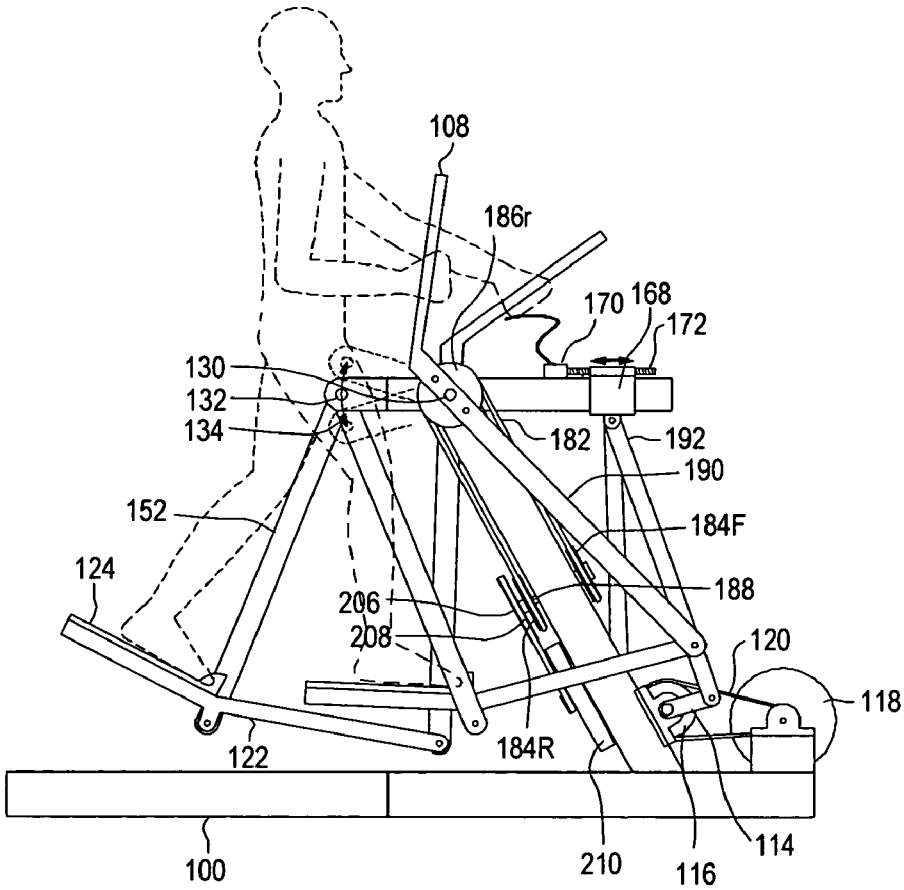
FIG. 10 depicts a side view of an embodiment of an exercise apparatus.

FIG. 10 depicts an alternate embodiment of a cross coupling system that may be used in the embodiment depicted in FIGS. 8 and 9. Pulley **186*r* and its mirror image pulley may be coupled to idler pulleys 184F, 184R with belt 182 so that the pulleys and the idler pulleys work in conjunction with each other. Belt 182 may be a continuous belt that is affixed to pulley 186*r* and its mirror image pulley. Pulley 186*r* and its mirror image pulley may be rigidly coupled to link members 190. Belt 182 may cause pulley 186*r* and its mirror image pulley to rotate in direct opposition to each other to cross couple the right and the left sides of the pivotal linkage pendulum system. In certain embodiments, idler pulleys 184F, 184R may be drive pulleys with overrunning clutches in their hubs. Overrunning clutches may cause unidirectional rotation of shaft 188 when idler pulleys 184F, 184R oscillate. In some embodiments, a bi-directional brake may be coupled to idler pulleys 184F, 184**R so that overrunning clutches are not needed. A bi-directional brake may be, for example, a friction disc brake, a band brake, or an electromechanical brake.

In certain embodiments, pulley device 206 may be coupled to shaft 188. Belt 208 may couple pulley device 206 to brake/inertia device 210. Brake/inertia device 210 may be a second brake/inertia device on the exercise apparatus. Brake/inertia device 210 may receive and store energy from horizontal motion of foot members 122. In some embodiments, brake/inertia device 210 may resist horizontal motion of foot members 122.

Figure 10A:
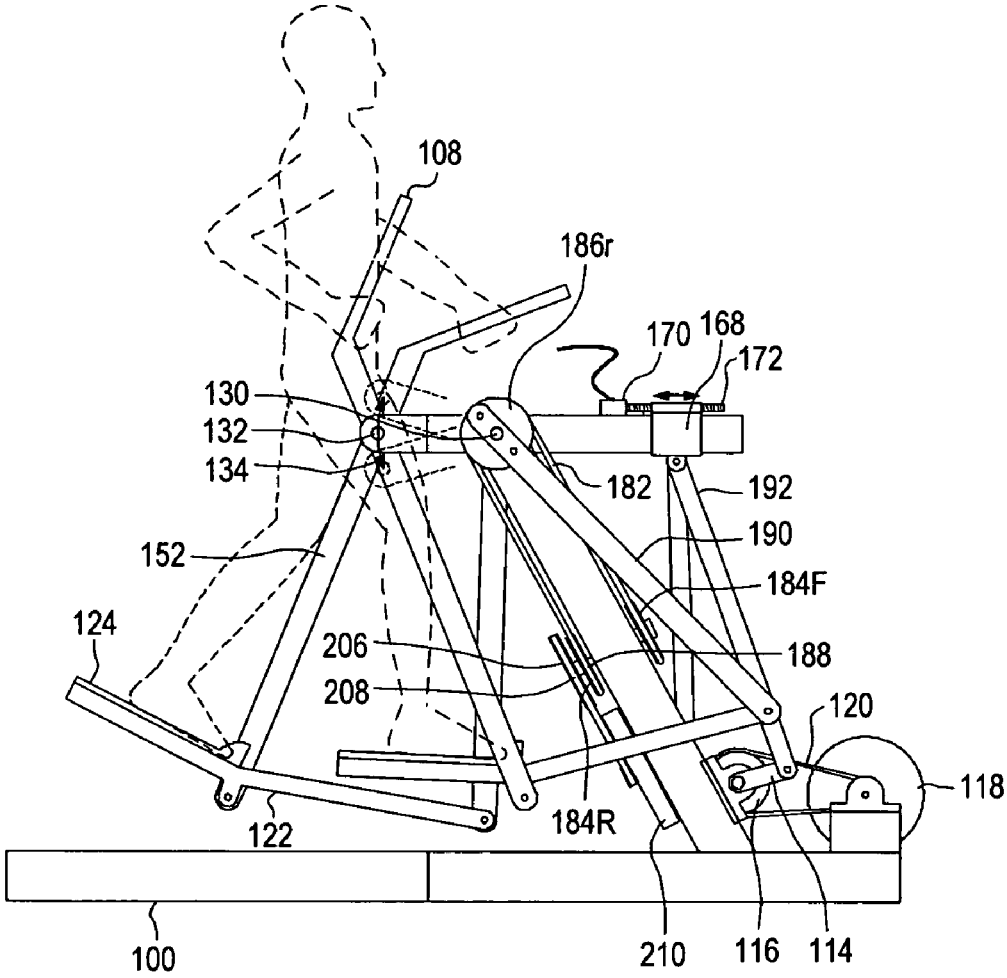
FIG. 10A depicts a side view of an embodiment of an exercise apparatus.

In some embodiments, arm link members 108 may be coupled to link members 152, as shown in FIG. 10A. Thus, arm link members 108 may extend a length of link members 152. The upper pivot point of link members 152 may be coupled to movable member 104 at point 132. In some embodiments, arm link members 108 may be included as a portion of link members 152 (i.e., arm link members 108 and link members 152 are made of a unitary construction). Arm link members 108 may include handles or other devices that may be grasped by a user of the exercise apparatus.

FIGS. 11-17 depict schematic representations of various embodiments of exercise apparatus that may allow motion of a user's feet similar to motion allowed by the embodiments depicted in FIGS. 4, and 6-10. Several embodiments are depicted herein as schematics to simplify discussion of pertinent features. Such depictions may not include one or more features that may be present in a fully functioning exercise apparatus. For example, only the right side foot member, right side footpad, right side movable member, right side link member, right side arm link member, and/or other right side selected components of the apparatus may be shown. In some embodiments, no pulley, belt, and/or brake/inertia system may be shown. In some embodiments, no right and left side cross coupling system may be shown. In some embodiments, one or more members in an apparatus may be straight, may be curved, may be unitary, or may be composed of multiple pieces.

Figure 11A:
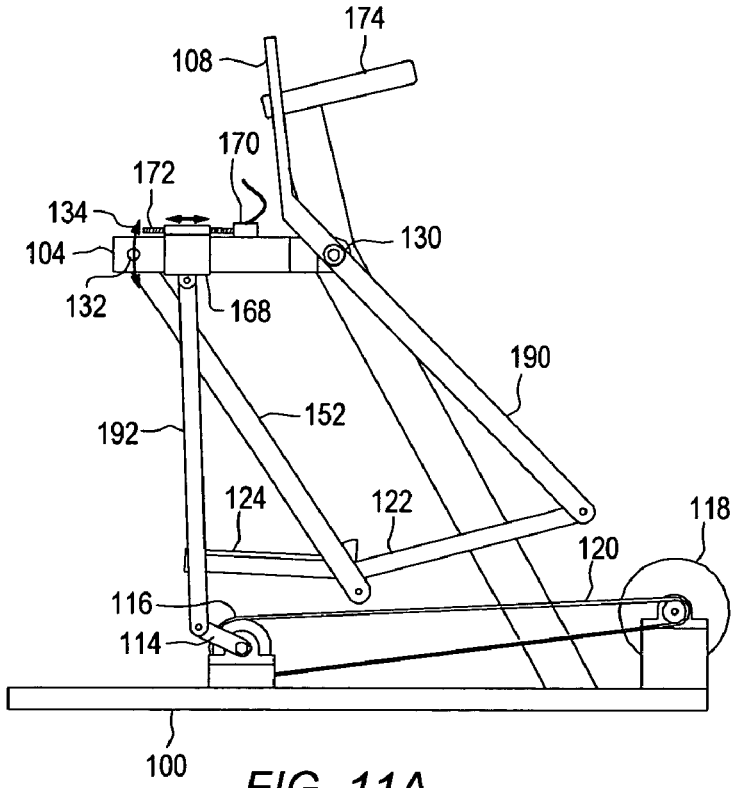
FIG. 11A depicts a side view of an embodiment of an exercise apparatus.

FIG. 11 depicts a side view of an embodiment of an exercise apparatus. Slider assembly 168 may be positioned on movable member 104. Movable member 104 may be coupled to point 130 and extend towards a rear end of frame 100. In certain embodiments, link member 152 is coupled to movable member 104 at a location between point 130 and slider assembly 168 on the movable member. In some embodiments, link member 152 is coupled to movable member 104 at point 132, which is at or near slider assembly 168, as shown in FIG. 11A. An upper pivot point of link member 152 may be coupled to movable member 104 at point 132. Link member 152 may act as a pendulum with a top of the pendulum being located at point 132. The embodiments depicted in FIGS. 11 and 11A may operate similarly to the embodiment depicted in FIGS. 8 and 9. In the embodiments depicted in FIGS. 11 and 11A, link member 192 may push movable member 104 upward to lift link member 152 and foot member 122 rather than pulling downwards to lift the link member and the foot member. Movable member 104 may be supported by the crank system through link 192 and slider assembly 168 and supported by the frame at point 130. Providing support to movable member 104 at these two locations provides structural support both in front of and behind a user that stands on footpad 124. In such an exercise apparatus, bearings or other coupling components located at, for example, point 130 and/or the coupling between link member 192 and movable member 104 may be subject to lighter loads than found in other embodiments of exercise apparatus in which large loads are placed on couplings in the apparatus. Thus, less expensive bearings or other coupling components may be used for certain exercise apparatus embodiments such as those depicted in FIGS. 11 and 11A.

Figure 12:
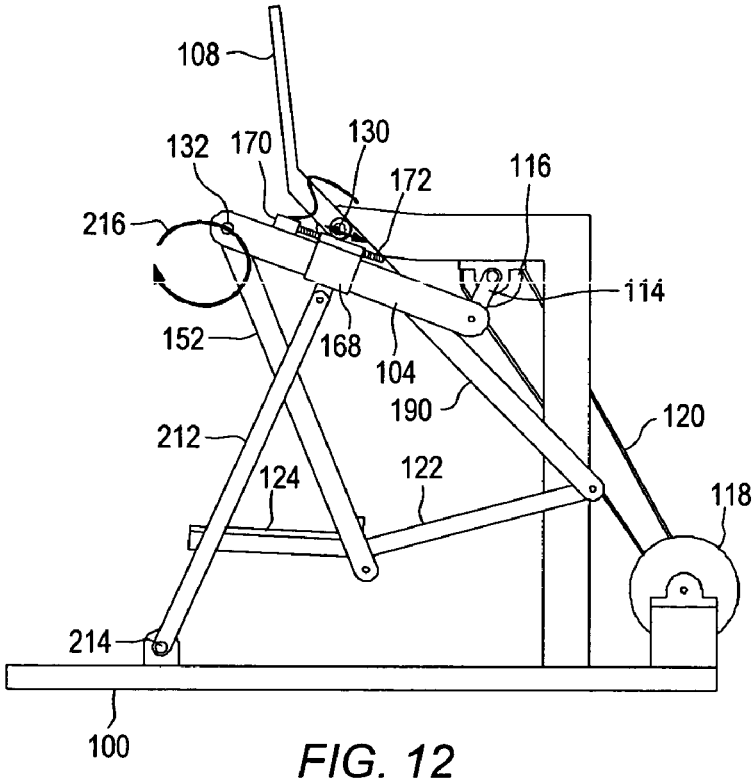
FIG. 12 depicts a side view of an embodiment of an exercise apparatus.

FIG. 12 depicts a side view of an embodiment of an exercise apparatus. Link member 152 may be coupled to an end of movable member 104. An upper pivot point of link member 152 may be coupled to movable member 104 at point 132. Link member 152 may act as a pendulum with a top of the pendulum being located at point 132. Movable member 104 may be directly attached to crank member 114 at a forward end of the movable member. Movable member 104 may be coupled to support link member 212. Support link member 212 may be pivotally coupled to frame 100 at point 214. Support link member 212 may constrain the motion of movable member 104. In certain embodiments, motion of crank member 114 may cause an end of movable member 104 opposite the coupling to the crank member to move in a closed path (e.g., an orbital path) of motion in space, which is approximately represented by arrow 216. This closed path of motion may be controlled by a geometry of the crank system, a geometry of the pivotal linkage pendulum system, and/or a position of slider assembly 168 along movable member 104. In certain embodiments, a majority of a path of motion of footpad 124 may be below this closed path of motion. In some embodiments, substantially all of a path of motion of footpad 124 may be below this closed path of motion. In certain embodiments, a hip of a majority of users may be positioned near at least a portion of the closed path of motion.

Figure 13:
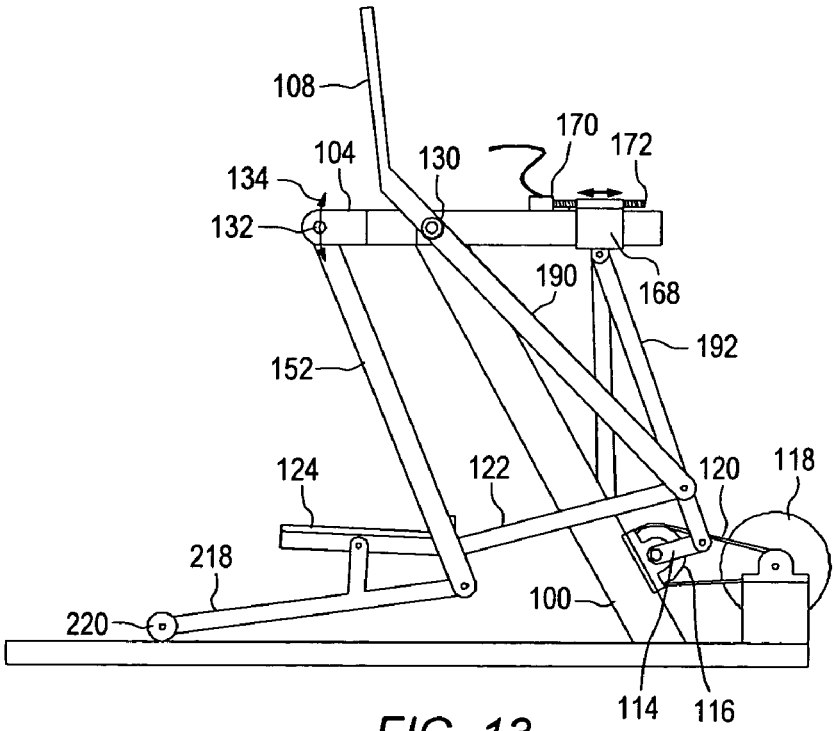
FIG. 13 depicts a side view of an embodiment of an exercise apparatus.

FIG. 13 depicts a side view of an embodiment of an exercise apparatus. Link member 152 may be coupled to movable member 104 at point 132. An upper pivot point of link member 152 may be coupled to movable member 104 at point 132. Link member 152 may act as a pendulum with a top of the pendulum being located at point 132. Link member 152 may be coupled to and provide at least some support to member 218. Member 218 may be supported by wheel 220, which engages the base of frame 100. A portion of member 218 may move in a back and forth path of motion along frame 100. In certain embodiments, a hip of a majority of users may be positioned near at least a portion of the back and forth path of motion at point 132. Member 218 may be pivotally coupled to foot member 122. Member 218 and wheel 220 may provide at least some support for a user's weight on foot member 122.

Figure 14:
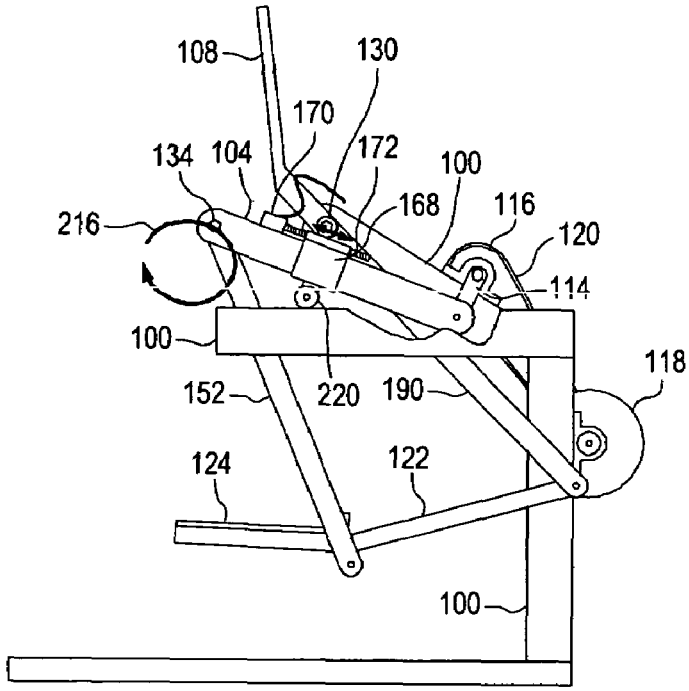
FIG. 14 depicts a side view of an embodiment of an exercise apparatus.

FIG. 14 depicts a side view of an embodiment of an exercise apparatus. Link member 152 may be coupled to movable member 104 at point 132. An upper pivot point of link member 152 may be coupled to movable member 104 at point 132. Link member 152 may act as a pendulum with a top of the pendulum being located at point 132. Movable member 104 may be directly attached to crank member 114 at a forward end of the movable member. Movable member 104 may be supported by and translate along an upper portion of frame 100. Link member 190 may be coupled to an upper portion of frame 100 at point 130. Wheel 220 may be coupled to slider assembly 168. Thus, wheel 220 is coupled to movable member 104 at a position determined by a position of slider assembly 168. Wheel 220 engages an upper portion of frame 100 to allow movable member 104 to translate along the upper portion of the frame. In certain embodiments, motion of crank member 114 causes an end of movable member 104 opposite the coupling to the crank member to move in a closed path (e.g., an orbital path) of motion in space approximately represented by arrow 216. This closed path of motion may be controlled by a geometry of the crank system, a geometry of the pivotal linkage pendulum system, and/or a position of slider assembly 168 along movable member 104. In certain embodiments, a majority of a path of motion of footpad 124 may be below this closed path of motion. In some embodiments, substantially all of a path of motion of footpad 124 may be below this closed path of motion. In certain embodiments, a hip of a majority of users may be positioned near at least a portion of the closed path of motion.

Figure 15:
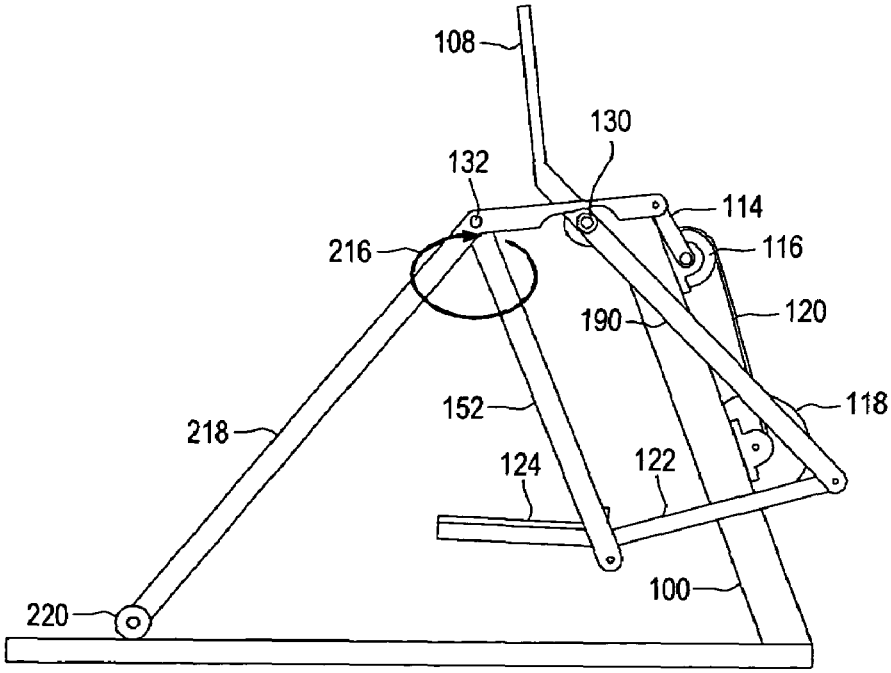
FIG. 15 depicts a side view of an embodiment of an exercise apparatus.

FIG. 15 depicts a side view of an embodiment of an exercise apparatus. Member 218 may be coupled to crank member 114 at one end and wheel 220 at another end. Wheel 220 engages the base of frame 100 and support member 218. Member 218 may be pivotally coupled to link member 152 at point 132. An upper pivot point of link member 152 may be coupled to member 218 at point 132. Link member 152 may act as a pendulum with a top of the pendulum being located at point 132. As crank member 114 rotates, point 132 moves in a closed path (e.g., an orbital path) of motion in space approximately represented by arrow 216. In certain embodiments, a majority of a path of motion of footpad 124 may be below this closed path of motion. In some embodiments, substantially all of a path of motion of footpad 124 may be below this closed path of motion. In certain embodiments, a hip of a majority of users may be positioned near at least a portion of the closed path of motion.

Figure 16:
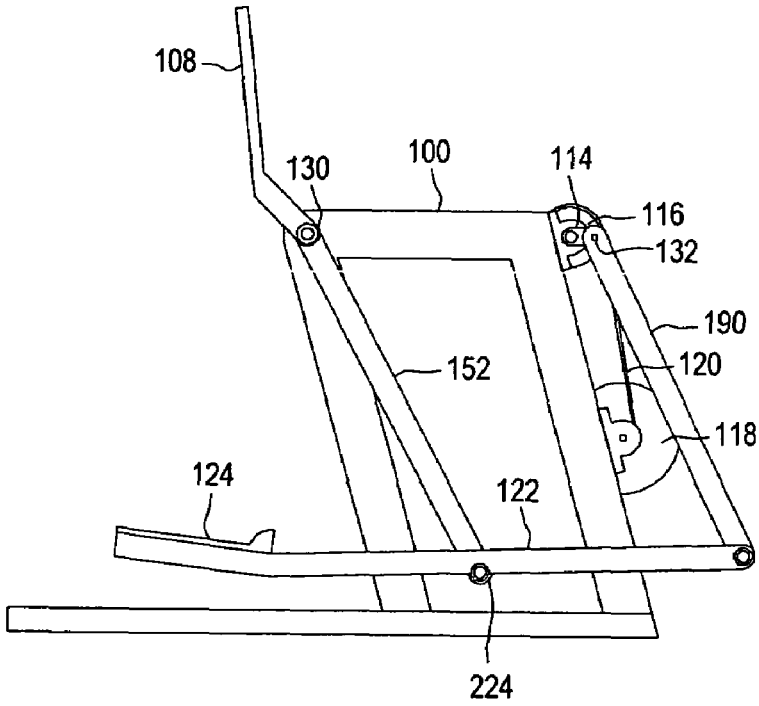
FIG. 16 depicts a side view of an embodiment of an exercise apparatus.
Figure 16A:
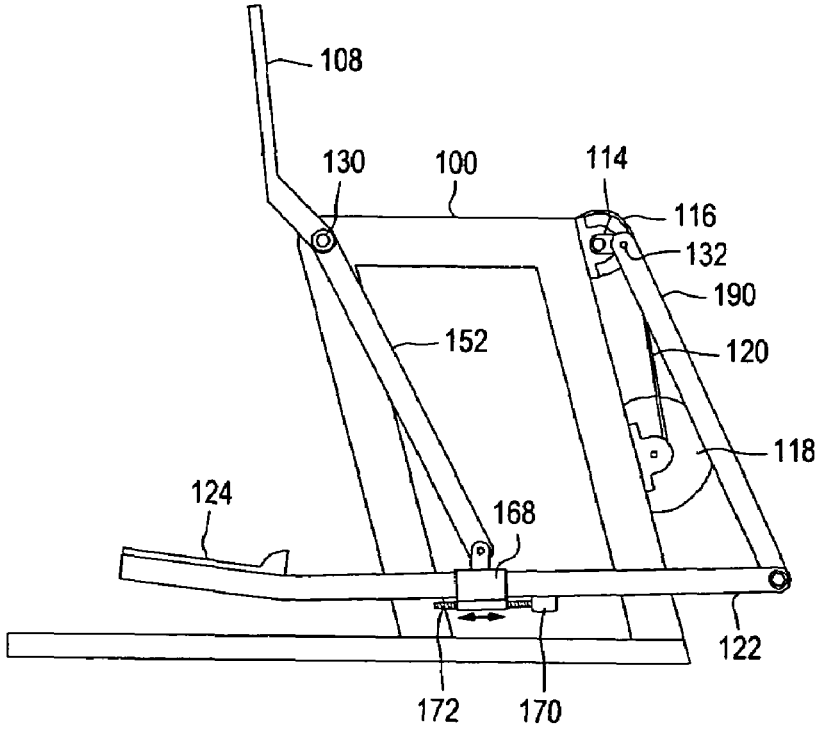
FIG. 16A depicts a side view of an embodiment of an exercise apparatus.

FIG. 16 depicts a side view of an embodiment of an exercise apparatus. Link member 190 may be pivotally coupled to crank member 114 at point 132. An upper pivot point of link member 190 may be coupled to crank member 114 at point 132. Link member 190 may act as a pendulum with a top of the pendulum being located at point 132. Foot member 122 may be pivotally coupled to link member 190 at or near a front end of the foot member. Link member 152 may be pivotally coupled to foot member 122 at point 224. In certain embodiments, link member 152 is slidably coupled to foot member 122 using slider assembly 168, as shown in FIG. 16A. Link member 152 may be coupled to frame 100 at point 130. An upper pivot point of link member 152 may be coupled to frame 100 at point 130. Link member 152 may act as a pendulum with a top of the pendulum being located at point 130. In the embodiments shown in FIGS. 16 and 16A, as crank member 114 rotates, the crank member causes the front end of foot member 122 to rise and fall. Thus, footpads 124 may rise and fall as crank member 114 rotates.

Figure 17:
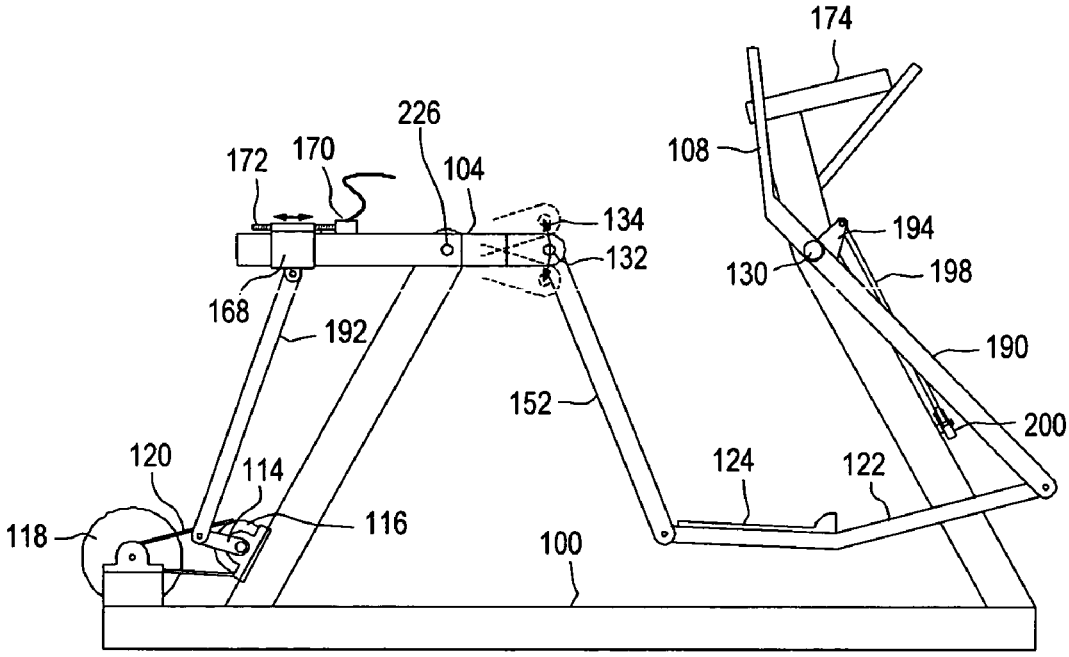
FIG. 17 depicts a side view of an embodiment of an exercise apparatus.

FIG. 17 depicts a side view of an embodiment of an exercise apparatus. Link member 152 may be coupled to movable member 104 at point 132. An upper pivot point of link member 152 may be coupled to movable member 104 at point 132. Link member 152 may act as a pendulum with a top of the pendulum being located at point 132. Link member 152 may be coupled to foot member 122 at or near a rear end of the foot member. Movable member 104, link member 192, and the crank system may be located at or near a rear of the exercise apparatus. Movable member 104 may be pivotally coupled to frame 100 at point 226. Movable member 104 may rotate or pivot about point 226. The embodiment depicted in FIG. 17 may operate similarly to the embodiment depicted in FIGS. 8 and 9.

Figure 18:
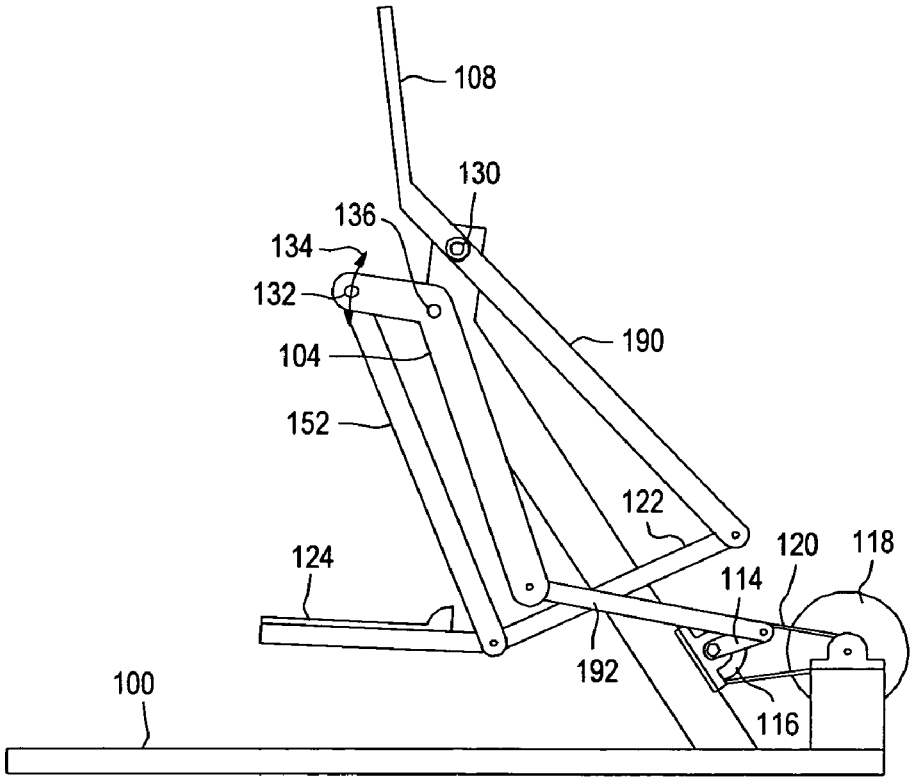
FIG. 18 depicts a side view of an embodiment of an exercise apparatus.

FIG. 18 depicts a side view of an embodiment of an exercise apparatus. Foot member 122 may be coupled to link member 152, link member 190, link member 192, and movable member 104. Foot member 122, link member 152, link member 190, link member 192, and movable member 104 may be members of a pivotal linkage pendulum system.

Link member 152 may be supported by movable member 104. Link member 152 may be coupled to movable member 104 at point 132. An upper pivot point of link member 152 may be coupled to movable member 104 at point 132. Link member 152 may act as a pendulum with a top of the pendulum being located at point 132. Movable member 104 may be an angled member, as shown in FIG. 18. Movable member 104 may be coupled to and supported by frame 100 at point 136. Movable member 104 may be coupled to crank member 114. During use, as crank member 114 rotates, the crank member may displace movable member 104 and cause an end of the movable member to move in a back and forth motion at point 132. The back and forth path of motion of movable member 104 at point 132 may cause an upper pivot point of link member 152 to move in a back and forth path of motion. In certain embodiments, a hip of a majority of users may be positioned near at least a portion of the back and forth path of motion.

Figure 19:
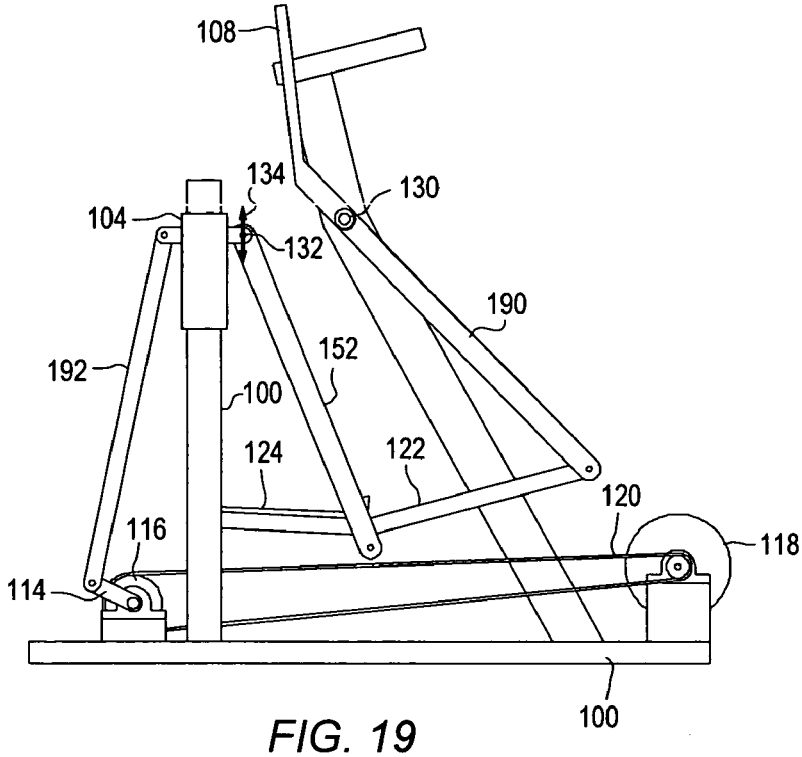
FIG. 19 depicts a side view of an embodiment of an exercise apparatus.

FIG. 19 depicts a side view of an embodiment of an exercise apparatus. Movable member 104 may move up and down a vertical portion of frame 100. For example, movable member 104 may slidably or rollably engage the vertical portion of frame 100. Link member 152 may be coupled to movable member 104 at point 132. An upper pivot point of link member 152 may be coupled to movable member 104 at point 132. Link member 152 may act as a pendulum with a top of the pendulum being located at point 132. Movable member 104 may be coupled to crank member 114 through link member 192. During use, as crank member 114 rotates, the crank member may displace movable member 104 and cause an end of the movable member to move up and down along a vertical portion of frame 100. The up and down motion of movable member 104 may be a linear back and forth motion approximately represented by arrow 134. The linear back and forth path of motion of movable member 104 at point 132 may cause an upper pivot point of link member 152 to move in a linear back and forth path of motion. In certain embodiments, a hip of a majority of users may be positioned near at least a portion of the linear back and forth path of motion.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. An exercise apparatus, comprising:

a frame configured such that at least a portion of the apparatus remains substantially stationary during use;

a crank system coupled to the frame;

a brake device coupled to the crank system and adapted to provide resistance to rotation of the crank system;

said apparatus having right and left sides, each such side comprising:

a pivotal linkage pendulum system comprising a movable member pivotally coupled to the frame at a first coupling location, a pendulum link member pivotally coupled proximate its upper end to the movable member at a second coupling location so that the pendulum link member may swing forward and rearward in a pendulum manner while the crank system remains stationary and not rotating, wherein the movable member is coupled to the crank system so that during crank system rotation the second coupling location moves in a path having two end points, the first end point being the highest point on the path and the second end point being the lowest point on the path; and a foot member comprising a foot pad, said foot member coupled to the pendulum link member proximate the lower end of the pendulum link member so that a vertical force applied to the foot pad by the user during a substantially vertical stepping motion causes continuous rotation of the crank system;

wherein a horizontal force applied by the user to the foot pad during a substantially vertical stepping motion causes a transition to a closed path walking, striding, or jogging motion having instantaneously variable horizontal amplitude.

2. The apparatus of claim 1, wherein a majority of the crank system is positioned in front of a footpad plane, the footpad plane being located at a center of the footpad, when the footpad is at a center of its path of motion during use.

3. The apparatus of claim 1, wherein a vertical amplitude of the path of motion of the second coupling location can be adjusted to vary a vertical amplitude of a path of motion of the footpad.

4. The apparatus of claim 1, wherein the movable member is coupled to the crank system at a third coupling location, and wherein a vertical amplitude of the path of motion of the second coupling location can be adjusted to vary a vertical amplitude of a path of motion of the footpad, and wherein the vertical amplitude of the path of motion of the second coupling location is user controlled by adjusting a position of the third coupling location.

5. The apparatus of claim 1, wherein the apparatus is configured so that a vertical amplitude of the path of motion of the second coupling location is equal to or greater than a horizontal amplitude of the path of motion of the second coupling location.

6. The apparatus of claim 1, further comprising a brake device coupled to the foot member, wherein the brake device is configured to resist horizontal motion of the foot of a user during use.

7. The apparatus of claim 1, wherein the apparatus is configured such that a hip of an average user is positioned near at least a portion of the path of motion of the second coupling location.

8. The apparatus of claim 1, wherein the pivotal linkage pendulum system further comprises a connecting link coupling the movable member to the crank system.

9. The apparatus of claim 1, wherein the right side foot member and the left side foot member are cross coupled.

10. The apparatus of claim 1, wherein each right and left side further comprise an arm link member, said arm link member pivotally coupled to the frame and pivotally coupled proximate its lower end to the foot member.

11. An exercise apparatus, comprising:

a frame configured such that at least a portion of the apparatus remains substantially stationary during use;

a crank system coupled to the frame;

a brake/inertia device coupled to the crank system and adapted to provide resistance to rotation of the crank system;

said apparatus having right and left sides, each such side comprising:

a pivotal linkage pendulum system comprising a pendulum link member and a movable member, said movable member pivotally coupled to the frame and coupled to the crank system, said pendulum link member pivotally coupled proximate its upper end to the movable member at a location displaced horizontally from the location of the pivotal coupling of the movable member to the frame so that during use the coupling location of the pendulum link member to the movable member moves in a path having a vertical amplitude upon rotation of the crank system while the lower end of the pendulum link member swings forward and rearward in a pendulum manner generally unconstrained by the rotation of the crank system; and a foot member coupled to the pendulum link member proximate the lower end of the pendulum link member, said foot member having a footpad;

wherein force may be applied by the user to the footpad to instantaneously vary among a substantially vertical stepping motion and a closed path walking motion, striding motion, or jogging motion, the horizontal amplitude of each such walking, striding, and jogging motion being instantaneously variable by the user when the user varies a force applied to the foot pad.

12. The apparatus of claim 11, wherein a majority of the crank system is positioned in front of a footpad plane, the footpad plane being located at a center of the footpad, when the footpad is at a center of its path of motion during use.

13. The apparatus of claim 11, wherein a vertical amplitude of the path of motion of the coupling location of the pendulum link member to the movable member can be adjusted to vary a vertical amplitude of a path of motion of the footpad.

14. The apparatus of claim 11, wherein a vertical amplitude of the path of motion of the coupling location of the pendulum link member to the movable member can be adjusted to vary a vertical amplitude of a path of motion of the footpad, and wherein the vertical amplitude of the coupling location of the pendulum link member to the movable member is user controlled by adjusting a position of the coupling between the pivotal linkage pendulum system and the crank system.

15. The apparatus of claim 11, wherein the apparatus is configured so that a vertical amplitude of the path of motion of the coupling location of the pendulum link member to the movable member is equal to or greater than a horizontal amplitude of the path of motion of the coupling location of the pendulum link member to the movable member.

16. The apparatus of claim 11, further comprising a brake device coupled to the foot member, wherein the brake device is configured to resist horizontal motion of the foot of a user during use.

17. The apparatus of claim 11, wherein the apparatus is configured such that a hip of an average user is positioned near at least a portion of the path of the coupling location of the pendulum link member to the movable member.

18. The apparatus of claim 11, wherein the pivotal linkage pendulum system further comprises a connecting link coupling the movable member to the crank system.

19. The apparatus of claim 11, wherein the right side foot member and the left side foot member are cross coupled.

20. The apparatus of claim 11, wherein the right and left sides further comprise an arm link member, said arm link member pivotally coupled to the frame and pivotally coupled proximate its lower end to the foot member.

21. An exercise apparatus, comprising:

a frame configured such that at least a portion of the apparatus remains substantially stationary during use;

a crank system coupled to the frame, said crank system comprising at least a right side crank member and a left side crank member;

a brake device coupled to the crank system and adapted to provide resistance to rotation of the crank system;

said apparatus having right and left sides, each such side comprising:

a pivotal linkage pendulum system comprising a pendulum link member and a movable member, said movable member pivotally coupled to the frame and coupled to the crank system, said pendulum link member pivotally coupled distal its lower end to the movable member so that during use the pendulum link may swing forward and rearward in a pendulum manner generally unconstrained by rotation of the crank system, said movable member configured so that during crank rotation the coupling location of the pendulum link member and the movable member moves along a path having first and second end points defining a vertical amplitude and a horizontal amplitude, the vertical amplitude of said path being equal to or greater than the horizontal amplitude of said path; and a foot member coupled to the pendulum link member proximate the lower end of the pendulum link member, said foot member having a footpad;

wherein force may be applied by the user to the footpad causing the footpad to vary among a stepping motion, a walking motion, a striding motion, or a jogging motion, the horizontal amplitude of said walking, striding, and jogging motions being instantaneously variable by the user when the user varies a force applied to the foot pad.

22. The apparatus of claim 21, wherein the apparatus is configured so that a vertical amplitude of the path of motion of the coupling location of the pendulum link member to the movable member is equal to or greater than a horizontal amplitude of the path of motion of the coupling location of the pendulum link member to the movable member.

23. The apparatus of claim 21, further comprising a brake device coupled to the foot member, wherein the brake device is configured to resist horizontal motion of the foot of a user during use.

24. The apparatus of claim 21, wherein the pivotal linkage pendulum system further comprises a connecting link coupling the movable member to the crank system.

25. The apparatus of claim 21, wherein the right side foot member and the left side foot member are cross coupled.

26. The apparatus of claim 21, wherein each right and left side further comprise an arm link member, said arm link member pivotally coupled to the frame and pivotally coupled proximate its lower end to the foot member.

* * * * *